US007300081B1

(12) United States Patent
Murray et al.

(10) Patent No.: US 7,300,081 B1
(45) Date of Patent: Nov. 27, 2007

(54) FLEXIBLE AUXILIARY HANDLE FOR HAND HELD IMPLEMENTS

(75) Inventors: Robert H. Murray, Fairport, NY (US); John R. Murray, 52 Manor Hill Dr., Fairport, NY (US) 14450

(73) Assignee: John R. Murray, Fairport, NY (US)

( * ) Notice: Subject to any disclaimer, the term of this patent is extended or adjusted under 35 U.S.C. 154(b) by 0 days.

(21) Appl. No.: 10/218,769

(22) Filed: Aug. 14, 2002

Related U.S. Application Data

(60) Provisional application No. 60/351,736, filed on Jan. 28, 2002.

(51) Int. Cl.
*B25G 1/02* (2006.01)

(52) U.S. Cl. ..... 294/58; 16/426

(58) Field of Classification Search ..... 294/54.5, 294/58, 59; 16/426, 427, 429
See application file for complete search history.

(56) References Cited

U.S. PATENT DOCUMENTS

| | | | | |
|---|---|---|---|---|
| 161,678 | A | 4/1875 | Gardner | |
| 344,890 | A | 7/1886 | Wilson et al. | 294/58 |
| 473,250 | A | 4/1892 | Carleton | |
| 715,056 | A | 12/1902 | Gruner | 294/58 |
| 911,291 | A | 2/1909 | Byor | 294/58 |
| 933,647 | A | 9/1909 | Hunt | 294/58 |
| 2,244,585 | A | 6/1941 | Tweit | 16/426 |
| 2,521,441 | A | 9/1950 | Bickley | 294/58 |
| 2,772,910 | A | 12/1956 | Doyle | 294/58 |
| 3,082,554 | A | 3/1963 | Steeb | 294/54.5 |
| 3,155,414 | A | 11/1964 | Bales | |
| 4,050,728 | A * | 9/1977 | Davidson | 294/58 |
| 4,155,582 | A | 5/1979 | Reisner | 294/58 |
| 4,200,324 | A * | 4/1980 | Helton | 294/58 |

(Continued)

FOREIGN PATENT DOCUMENTS

| | | |
|---|---|---|
| CA | 2134992 | 5/1996 |

(Continued)

OTHER PUBLICATIONS

Applicant's photos of product, 2-pages, regarding Emsco Retention Bosses and Handle, relating to product using US patent 6,062,619, no date.

(Continued)

*Primary Examiner*—Dean J Kramer
(74) *Attorney, Agent, or Firm*—Simpson & Simpson, PLLC

(57) ABSTRACT

A flexible auxiliary handle having an elongate member having a hand grip portion associated with a first end and an attaching portion associated with a second end wherein the elongate member provides for torsion or bending or both in response to motions and forces applied to the grip portion. The elongate member is typically advantageously comprised of one or more segments having characteristics enabling such action. The flexible handle ergonomically allows the gripping hand to move freely while the implement's tool maintains orientation to the ground without undue need for balancing, or for avoiding or performing certain undesirable movements customary with auxiliary handles. Such auxiliary handle is attractive, lightweight, cost effective to manufacture, has many configurations, conserves implement storage and retail space, installs and adjusts without tools, fits a wide variety of implements, enables conventional implement use, remains within easy grasp of the user, and is pleasurable to own.

277 Claims, 8 Drawing Sheets

U.S. PATENT DOCUMENTS

| | | | | | |
|---|---|---|---|---|---|
| 4,793,645 | A | | 12/1988 | Decker | 294/58 |
| 4,794,667 | A | | 1/1989 | Nelson | 16/114 R |
| 4,911,575 | A | | 3/1990 | Tidwell | 404/97 |
| 5,133,582 | A | * | 7/1992 | Rocha | 294/58 |
| 5,331,720 | A | * | 7/1994 | Beckingham | 16/426 |
| 5,400,471 | A | | 3/1995 | Lichfield | 16/114 R |
| 5,447,349 | A | * | 9/1995 | Coble | 294/58 |
| 5,451,085 | A | | 9/1995 | Wagner | 294/58 |
| 5,472,252 | A | | 12/1995 | Barone | 294/58 |
| 5,487,577 | A | | 1/1996 | Ball | 294/58 |
| 5,496,085 | A | | 3/1996 | Middleton | 294/58 |
| 5,499,852 | A | | 3/1996 | Seigendall | 294/58 |
| 5,533,768 | A | | 7/1996 | Mitchell | 294/54.5 |
| 5,695,231 | A | | 12/1997 | Hoffman | 294/58 |
| 5,704,672 | A | | 1/1998 | Sims | 294/58 |
| 5,871,246 | A | * | 2/1999 | Simdom | 294/58 |
| 6,062,619 | A | | 5/2000 | Clark | 294/58 |
| 6,203,081 | B1 | | 3/2001 | Kegan | 294/59 |
| 6,283,522 | B1 | | 9/2001 | Renaud | 294/58 |
| 6,485,076 | B1 | | 11/2002 | Chang | |
| 6,601,887 | B2 | | 8/2003 | Graves | 294/58 |
| 6,704,968 | B2 | | 3/2004 | Lau | |
| 2003/0057721 | A1 | | 3/2003 | Ducklow | 294/58 |
| 2003/0173789 | A1 | | 9/2003 | Piscopo | 294/58 |

FOREIGN PATENT DOCUMENTS

| | | |
|---|---|---|
| CA | 2154398 | 3/1997 |
| CA | 2222255 | 8/1999 |
| FR | 1041062 | 10/1953 |
| FR | 1323239 | 2/1963 |
| FR | 1446837 | 6/1966 |
| GB | 974584 | 11/1964 |
| GB | 2117615 A | 10/1983 |
| GB | 2156641 A | 10/1985 |
| GB | 2266438 | 11/1993 |
| JP | 60-129328 | 7/1985 |
| JP | 61-146927 | 7/1986 |

OTHER PUBLICATIONS

Internet: "Unc' Randall's Easylift Handle" from inventor Randall Ball of 5,487,577; printouts from presently—inoperative websites www.easylifthandle.com (Oct. 20, 2001) & www.horseandpet.com (Dec. 31, 2001).

Changer's Universal No Bending Handle—Feb. 20, 2006.

* cited by examiner

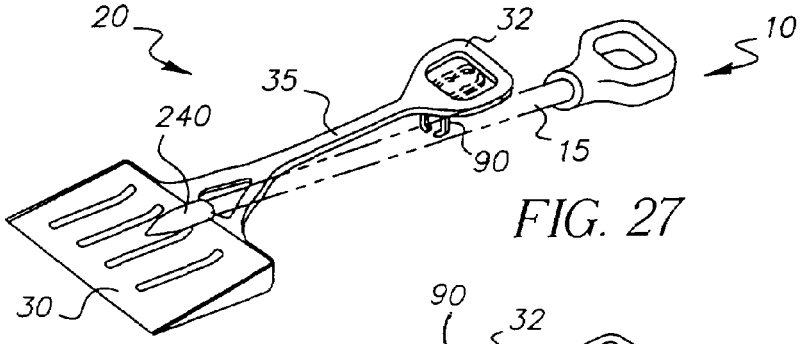
FIG. 27
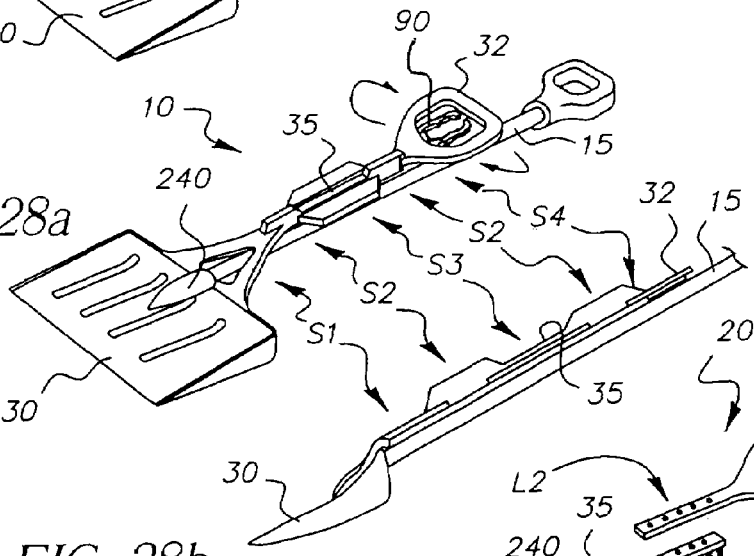
FIG. 28a
FIG. 28b
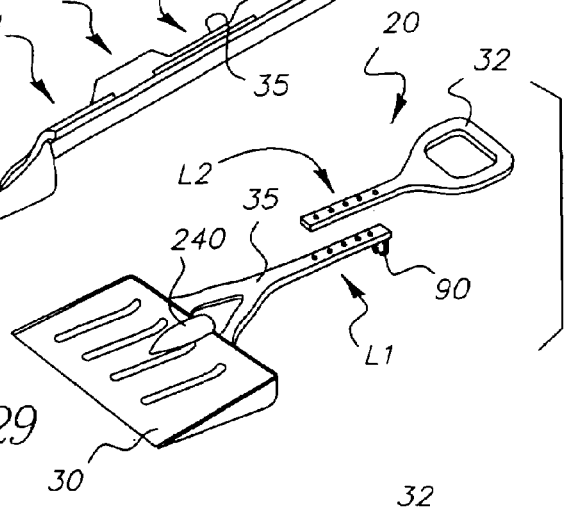
FIG. 29
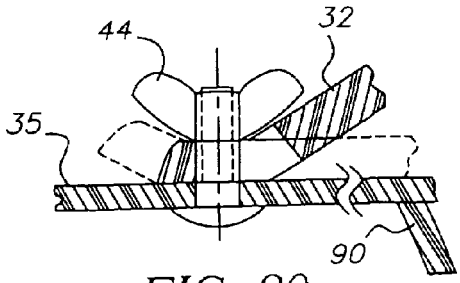
FIG. 30
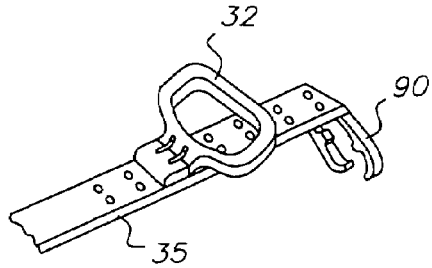
FIG. 31

FLEXIBLE AUXILIARY HANDLE FOR HAND HELD IMPLEMENTS

This Application is based on Provisional Application No. 60/351,736 filed on Jan. 28, 2002.

FIELD OF THE INVENTION

The present invention relates to auxiliary handles, in some patents called a second handle, which are flexibly responsive to a users motions, for use with hand held implements and tools, and in particular, with shafted implements such as snow shovels, digging shovels, rakes, hoes, vegetation trimmers, and the like.

BACKGROUND OF THE INVENTION

Auxiliary handle inventions which provide ergonomic benefit to hand manipulated implements are well known. However, most have one or more drawbacks which limit their usefulness and ability to accomplish the objectives for which they were conceived. Some auxiliary handles are pivotally mounted and some are mounted using free moving rings or ropes or wires, and some use omnidirectional-motion-enabling springs and like elements to accomplish connection and useful purpose.

Most auxiliary handles for implements are difficult for manufacturers to build and install, or for users to install without making modifications to the implement or without the need for tools. The handles often are typically awkward to use, lack suitable adjustment means for differing users or changing task conditions, interfere with the conventional use of the implement, add to the weight of the implement, or suffer from a lack of freedom of desired movement, which then leads to ergonomic strain and fatigue, poor work quality, and productivity loss. The majority of auxiliary handles seem to suffer from some significant shortfall or another. The examples which follow explain some of the advantages and difficulties.

The earliest and most familiar designs that are widely recognized are the pivotally attached auxiliary handles. These are good for obtaining leverage for lifting and lowering implements yet are typically difficult to install without tools, add to the weight of the implement, are costly to manufacture, are susceptible to corrosion, and interfere with storage or transportation. More importantly, however, these designs cause the working head of the implement to change orientation with respect to the ground if the auxiliary hand grip is moved laterally during use. Such occurrence often results in unintentional tool action such as dumping a load when using a shovel or undesirably scalping the ground and producing hazardous flying debris in the case of a vegetation trimmer. As well, such characteristics often require a user to adopt unusual motions or posture to avoid such effects and result in early fatigue and soreness while general work quality and productivity suffers. Such combination of characteristics makes the pivotal design suitable for only a few special tasks and hence is rarely seen in the general marketplace.

To overcome these effects, new handle designs were developed that eliminated the implement's reorientation effect when the auxiliary hand grip was moved laterally. These are comprised mainly of swivellable collars and linkages, swivellable wires, as in Bickley U.S. Pat. No. 2,521,441, swivellable rings, or various innovative combinations of these as in Clark U.S. Pat. No. 6,062,619. Other designs toward such goal include simple ropes, and bungee cord type configurations. These inventions successfully provide a wide range of motion and freedom yet so much so that in practice they are generally unstable. An interesting feature of these designs is that they require a user to continuously balance the implement. Curiously, the balancing force can only arise from the hand which grips the implement itself since the grip-hand holding the auxiliary handle cannot exert any stabilizing force because of its high degree of freedom of motion laterally. This effect also means that any loading of the implement must be balanced by the single hand gripping and operating on the implement itself. Typically the motion control task of this hand involves muscles of the forearm and wrist using a twisting action which reverses frequently according to the implement's dynamic balancing needs, and is accomplished while this hand is gripping in relatively tight fashion so to be ready for response to the highly varying loading conditions. For shoveling, this results in significant ergonomic strain by placing a relatively large and continuous yet rapidly varying load force requirement upon relatively weak muscle groups and systems of the wrist and forearm, and typically with minimal periods for rest, a condition-set which is generally known as an ergonomically undesirable practice. Relief is possible if one switches hands, however such action is inconvenient and awkward and results in productivity loss due to differences in skill when using one hand versus another, in the time and effort taken to make the switch, and in the opportunity available to drop the auxiliary handle during the switch.

Another important and less desirable aspect of these designs is that, due to their omnidirectional nature, the auxiliary grip handle must be continuously held in order to avoid having it fall to the ground or to avoid the need to make a storage action if the handle needs to be released momentarily, as is common during material-shoveling. Too, once stored, the handle must then be retrieved, which is inconvenient. Releasing the handle without stowage causes it to fall to the ground, often creating a hazard during the fall, a tripping hazard afterward, and a potential for ergonomic strain in retrieving the grip handle from a position adjacent to the ground. Though the advantages of these designs are readily apparent their less obvious aspects have apparently prevented these devices from achieving broad acceptance in the marketplace.

Other auxiliary handle designs address and allay such needs for balancing and eliminate the need for continuously holding the hand grip by having the benefit of automatically returning the grip handle to an easily grasped position. These designs are considered self-returning auxiliary handle designs. A number of designs are known. Unfortunately, these designs have design-specific performance shortfalls which either reintroduce a deficit from earlier handle designs, or create new performance and construction issues.

The first of the returnable design examples is by Decker U.S. Pat. No. 4,793,645. This design uses an elastomeric living hinge in an open-mouth bird-beak-like configuration which helps connect the auxiliary handle to the implement and which closes as the auxiliary handle is lifted for use and which returns the handle to its non-loaded condition when released. Though the handle returns to its starting point, the nature of this design, due to its hinge's relatively immovable and definitive line of action, limits the hand grip's lateral freedom of motion in similar aspect to pivotally mounted auxiliary handles. Thus, while such was an improvement for returning the handle, the limited motion of the grip remained.

A second type of returnable handle has fewer limitations on its motion yet significant drawbacks remain, and relate to reorientation of the tool with respect to the ground. These designs are also typically expensive to manufacture and add to the weight of the implement.

These are auxiliary handle designs which are omnidirectional and which return to a starting point using springs or elastomeric elements and are commonly known. Ball U.S. Pat. No. 5,487,577 shows a substantial spring element which provides omnidirectional freedom of motion of a hand grip which is fixed to the top of a shaft, as visually interpreted therein and similar to other known devices, which shaft itself is then connected to the implement through the spring element. Other known devices are of similar construction. Observation of users shows that rotation of the fixed grip member about its own axis is immediately and substantially transferred into a highly undesirable rotation effect on the implement about the implement's predominant longitudinal axis, thereby changing the orientation of the tool portion of the implement with respect to the ground. While this could be helpful in some circumstances, the unintended and undesired result is typically that the load is unintentionally dumped as for a shovel, or in cutting too close to the ground as in a vegetative trimmer. In order to overcome this undesired situation users are typically required to adopt awkward postures and to make unnatural motions and must take unusual care to avoid rotation of the hand grip so that the implement stays usefully oriented. This inability of being able to perform such natural motions requires constant mental effort and user-attention to maintain. As well, it is frustrating and productivity hindering during lapses of focus that then result in mistakes and poor task actions. Such unnatural grip orientation requirements also results in the repetitive-use of a substantially single-set of muscles of the forearm of the grip-hand, and thus is physically straining and tiring.

Another ergonomic result of such unnatural grip orientation is that it tends to cause the user to pronate the wrist at a ninety degree angle when tossing a load forward as for a shovel or when reaching as for a vegetation trimmer. This effect is due to the combination of the user's firm grip on the auxiliary handle in order to controllably hold it and the need for the grip to maintain a non-rotated orientation so to maintain tool orientation. A possible solution to this pronation would be to provide a hand grip which could rotate generally about its axis. Such a modification would allow the grip hand to move into alignment with the forearm during such toss and reach motions, thereby eliminating or assuaging the non-ergonomic 90 degree pronating wrist-bend. Unfortunately adding such swiveling features to the hand grip and its mounting to allow such hand-rotation is technically difficult, costly to manufacture, and prone to performance issues such as jamming or excessive looseness and poor ergonomic feel. It is also notable that for such omnidirectional or similar spring-loaded-like designs, if the grip handle is simply released, it can snap-back to the main handle and to the user's body with much force and can cause injury or hazardous evasive action. Furthermore, this effect is largely dependent on the choice of connecting element, which for such design configurations must be fairly substantial for reliability performance reasons such that such snap back seems nearly unavoidable.

Another notable feature of such stiff, returnable omnidirectional type auxiliary handle constructions is that lateral motion of the hand grip to any position other than directly over the implement main handle results in an undesirable rotation of the implement and reorientation of the implement's tool portion relative to the ground similar to the effect of rotating the fixed hand grip. This motion is also similar to pivotally attached auxiliary handle designs and so is a surprising and unexpected undesirable result given the appearance of such devices to the contrary.

This surprising action arises and is thought to be explained as follows: when performing a typical lifting action, as the user's hands which are gripping the implement and the auxiliary hand-grip are moved in the principal lifting or typical forward-tossing-motion and direction-of-use they tend to oppose each other directly and thus the effort of one hand can oppose the effort of the other and allow the substantial spring element to be overcome to allow the auxiliary handle to be raised away from and returned to the implement main handle. Taking this concept one step further, one notices that when such auxiliary-grip is moved laterally there is effectively no appreciative opposing force other than the leverage effect of the load on the tool and/or the user's hand gripping the implement main handle to counteract or bear against the substantially stiff connecting element as the users auxiliary grip hand naturally moves laterally to tilt or cant the auxiliary handle to sideward during-use. Such motion tries to force the spring element into further bending and in a different direction so that the lateral motion of the auxiliary hand, rather than producing a further bend in the element in a lateral direction, such lateral movement (of the auxiliary grip), is converted into rotation of the implement, which is typically undesirable.

As well, a surprisingly hidden contributing factor, and perhaps more explanatory for such rotations, is that while the spring or stiff bending-element is in the bent state and with the auxiliary handle moving laterally, the spring's bent shape acts as a kind of an L-shaped mechanical-crank which is integral throughout its shape, and because of this, the sideways lever motion of the auxiliary handle is transmitted directly and immediately to the implement main handle through the spring and main-handle connection. Similarly interesting, for a torque applied to a fixed auxiliary handle connected to such a spring or omnidirectional linkage, the applied torque operates in a manner much like a rotary linear transmission made from a long spring in a nonfunctional casing much like those typically used on electric drills for fine polishing or grinding wherein a torque at one end is output as rotation at the other end, thereby auxiliary handle grip rotation would be inducing rotation of the implement and hence also its tool portion, which can create fatigue and ergonomic strain to accuracy control to maintain job performance. As well, it is thought that such a sideward handle motion acting on any bent flexible cylindrical item will to some extent naturally induce a torsion and differential twisting within such item and which torsion, depending on apparatus-construction, would necessarily be transferred and act on the ends of the item, and which general effect might be explained in a manner much like the wire strand in the coil of a spring under load and which internal-torsion mechanical-effect or mechanism, if present, may also contribute to the implement rotation effect observed.

Reflecting on the undesired implement rotation effects of such constructions of omnidirectional, self-returning, auxiliary handle devices it appears that these devices were developed mainly as a way to overcome the load balancing and handle grasping deficits of the omnidirectional auxiliary handles which came before them. It is notable that it appears that most all omnidirectional auxiliary handle devices which return to their starting point provide some useful benefit yet remain comprised of many parts, add weight to the implement, are costly and difficult to manufacture and install, and suffer from one or more alternate compensating performance deficits, and could be physically hazardous to the user.

Characteristics such as these seem to have prevented these self returning devices from achieving widespread success, much like the others.

As well, as review, and in general, many of the previous auxiliary handle designs to-date have substantial performance and ergonomic deficits in addition to being costly to manufacture, are difficult to install, require tools to install, require modification of the implement to install, add to the weight of the implement, require stowage of the handle upon release, provide difficulty in controlling the implement, require continuous balancing of the implement, or require refraining from certain highly-desired and comfortable motions.

It is, therefore, desirable to develop an auxiliary handle for hand held implements which solves most, if not all, of the preceding problems.

SUMMARY OF THE INVENTION

In particular, this invention relates to a flexible auxiliary handle for attaching to a hand held implement or tool to make it easier for the user to use and to control the tool, and relates to shafted implements in particular. As used herein, shafted implements refer to hand held tools which may include motorized and non-motorized tools having a rigid handle such as shovels, snow shovels, pitchforks, string trimmers, hedge trimmers and the like.

It is recognized that the auxiliary handle here described can be rigidly mounted or pivotally attached to an implement's main handle or its working head, or be molded or formed or fabricated integrally with any portion of the implement whether the main handle, the working head, or otherwise. As well it is recognized that the auxiliary handle can be fabricated in various lengths such as from a few inches to a few feet long to suit the implement or task need or desire.

The invented handle principally reduces strain on the user's wrist and back by being flexibly responsive to the users natural arm and torsional wrist movements when controlling the tool and by significantly reducing the user's need to stoop when using long handled implements.

The flexible auxiliary handle includes an elongate flexible member that is torsionally flexible as well as bendable, or some combination thereof, for the purpose of selectively transmitting and dissipating the user's wrist and arm forces to the implement. A hand grip portion is associated with one end of the elongate member and an attaching portion is associated with the other.

The auxiliary handle is typically made of plastic or metal or other suitable material, preferably as a unitary device, yet can be made from an assembly of such parts or be of a composite fabrication of these or similar performing materials. The bendability and torsional performance which makes this handle useful arises over the full length of the elongate member or in one or more localized regions or zones or sections advantageously having characteristics enabling such action.

The disclosed auxiliary handle also makes possible lateral motion of the hand grip crosswise to the implement's main handle without affecting the orientation of the implement's working head with respect to the ground, while also providing an auxiliary handle which is self supporting, and that keeps the auxiliary handle's grip portion within easy grasp of the user, which factors of operation it appears in the history of this field to be matters of some consequence given the culmination of preceding art and the attendant difficulties previously described. This auxiliary handle is also particularly important as it virtually eliminates the need for fatiguing non-ergonomic task-motions in order to maintain the implement's orientation relative to the ground for accomplishing task-productivity, as is required with current auxiliary handles.

This invention also helps to balance the implement and its load without the need for undue user intervention during use of the auxiliary handle, which is an important matter in the industry for ease of use and ergonomic-reasons/comfort.

As well, as mentioned or alluded to previously, the flexible auxiliary handle is self supporting, remains readily available for grasping at the task outset, returns automatically after being temporarily released, and substantially does not interfere with use of the implement in its conventional or usual manner. As well, the device is light in weight, is cost effective and easy to manufacture, is conducive to display in stores, provides a variety of possible product configuration alternatives, can be readily attached to implements without tools, and is adjustable by the user without tools.

Therefore the general aim of the present invention is to combine the myriad benefits of the prior art while overcoming the myriad deficits thereof. Disclosed is a device which is substantially omnidirectional, self supporting, easy and cost effective to manufacture, installs without tools by the user, fits on a wide variety of implements without adaptation, is light in weight, is unaffected by dirt or sand in the use environment, provides for balancing the load with minimal to no user intervention, allows the hand grip to be moved laterally or to be torsionally rotated, or both simultaneously, without noticeably rotating the implement or affecting the orientation of the tool portion relative to the ground, is easy to adjust to user preferences or task—without tools and with or without gloves on, allows use of the implement in a conventional manner, is compact and easy to store and transport while installed, is compact and suitable for high density and damage-less display in retail environments as an end item or pre-configured on an implement, and provides the user with a pleasurable overall operating and owning experience.

BRIEF DESCRIPTION OF THE DRAWINGS

FIG. 27 is a ¾ view of the invention molded integrally with a primary unit.

FIG. 28*a* is a is a ¾ view representing an integral composition of the invention with a working head and further illustrating the invention descriptive model.

FIG. 28*b* is a ¾ view representing an integral composition of the invention with a working head and further illustrating the invention descriptive model.

FIG. 29 is a ¾ view of a means to adjust the length of the flexible web when a section of the elongate member is integral with the working head.

FIG. 30 is a sectional view of a reorientable tilting handle for compact shipping in one mode and improved user access in another.

FIG. 31 is a partial view of a method for adjusting the position of the hand grip on the elongate member to suit user preferences.

DETAILED DESCRIPTION OF THE INVENTION AND PREFERRED EMBODIMENT(S)

Figure 1:
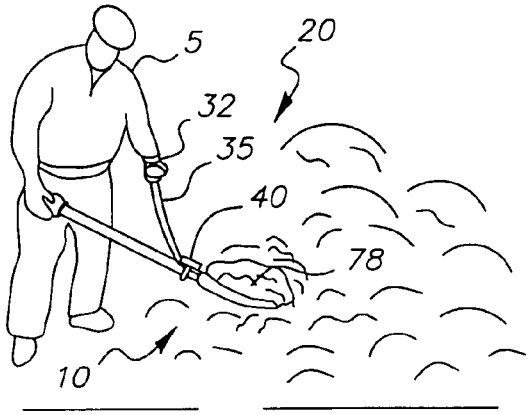
FIG. 1 is a profile view of a user lifting and tossing a snow load.

The present invention is herein referred to generally as a flexible auxiliary handle assembly or auxiliary handle for attaching to a hand manipulatable implement, (which latter sometimes is called a primary unit and comprised of a rigid or primary handle and a tool element), for the purpose of selectively transmitting desired lifting, twisting and pushing forces from a user's arm and wrist to a primary implement and thereby enabling comfortable and efficient use and control of the implement without risk of injury to the user's wrist or back.

While the term assembly is used throughout the most likely configuration is that of unitary construction of plastic or metal or other suitable material rather than a joining of separate components though such configurations are possible and useful. As well it is noted that many of the illustrations show a grip handle which is integral or fixedly joined at one end of the auxiliary handle; it is noted that a swivel-able grip handle is also envisioned and useful with this invention.

A snow shovel will be used as an example in describing the invention. The auxiliary handle assembly 20 has many applications and configurations, for example, different kinds of shovels, pitchforks, hedge clippers, vegetation trimmers and the like, powered or otherwise, and can take on many different lengths and shapes and configurations. These will be referred to as a hand manipulatable implement 10, and at times referred to as a primary tool 10, having a working head 30, and a main handle 15 which is at times referred to as a rigid or primary handle 15. The first two figures are sequenced to provide background and notes helpful to reading the detailed descriptions of the preferred embodiments which follow.

FIG. 1 shows a view of a user 5 in the process using an auxiliary handle assembly 20, also called an auxiliary handle, for tossing a generic load 78, also called a load, to the side and upward toward the top of a large pile of snow while maintaining an upright posture.

The auxiliary handle assembly 20 is comprised of an attaching means 40, also called an attaching portion, an elongate member 35, sometimes called a web or a flexible member or a flexible web, and a hand grip portion 32, also called a grip portion or a hand grip or a grip element. Notice the wrist twist that the user has imparted to the hand grip portion 32 that is associated with one end of the elongate member 35, which is connected to an implement 10, also called a shafted implement or a primary unit or a shovel unit, through the attaching means 40, which is associated with the other end of the elongate member 35. Notice also the horizontal orientation and lack of tilting of the shovel unit 10 in response to such wrist twist of the hand grip portion 32. As well, notice, as indicated from the user's body position relative to the position of the implement 10 that the user's hand gripping the hand grip portion 32 is positioned off to the side and is positioned other than directly over the implement 10 yet the implement 10 with the load 78 remains level as the load is directed during tossing.

Figure 2:
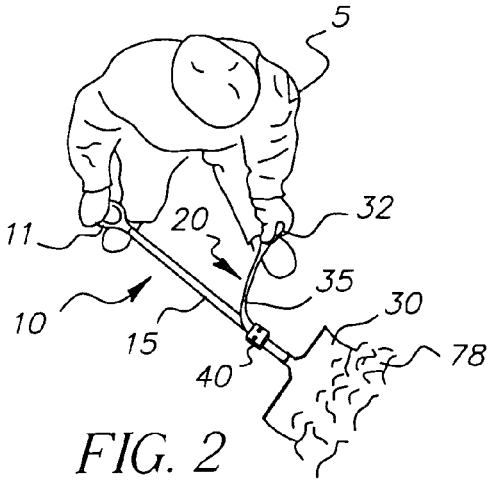
FIG. 2 is an overhead view of a user performing a sweeping action with light snow using an embodiment of the flexible auxiliary handle.

FIG. 2, shows an overhead view of the user 5 at some other time and using the auxiliary handle assembly 20 in a relaxed sweeping motion to obtain the load 78 in a direction to the user's left for capture onto a working head 30, sometimes called a tool portion or a tool or a primary tool and in this case called a shovel blade. The auxiliary handle assembly 20 is attached to the implement 10 by the attaching means 40 to a main handle 15, also called a rigid handle or primary handle, of the implement 10. Note the bending and flexing of the elongate member 35 as well as the position of the hand grip portion 32 being positioned laterally to the side of the main handle 15 rather than being positioned directly over it. Notice that this positioning arises from the yielding and bending of the elongate member 35 to the user's natural wrist and arm movement and that the working head or shovel blade 30, obscured by the load 78 in this figure, remains parallel with, and for this task, in contact with, the ground for which the ground is implied yet not shown in this figure.

This figure is also generically indicative of the user 5 in the process of swiftly tossing a gathered load 78 from an upright and comfortable posture while the hand grip portion 32 is displaced laterally of the main handle 15 while the working head or shovel blade 30 remains substantially level with the ground.

This figure is also generically indicative of the user 5 lifting the load 78, and too, of the user 5 carrying and directing the load 78 during transport, from an upright and comfortable posture while the hand grip 32 is able to be moved laterally to the side of the main handle 15 yet with the working head or shovel blade 30 remaining substantially level with the ground.

Figure 3:
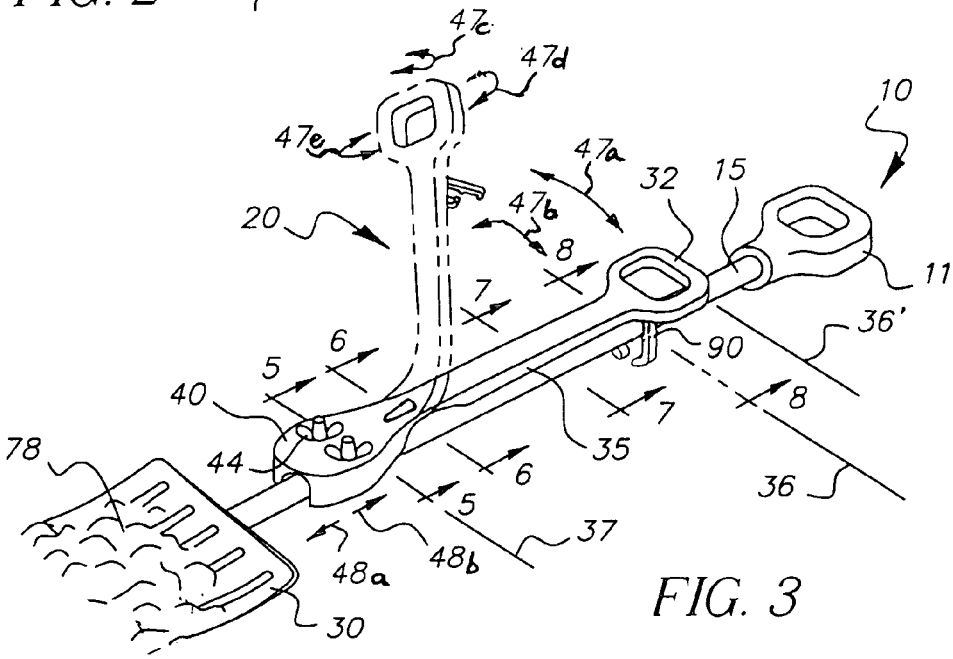
FIG. 3 is a ¾ view of a preferred embodiment of the flexible auxiliary handle showing possible flexible responses of the elongate member.

FIG. 3 shows one of several preferred embodiments shown in a position where working head 30 is level with yet not in contact with the ground which is implied yet not shown in this figure.

This preferred embodiment is that of the auxiliary handle assembly 20 connected by the attaching means 40 to the main handle 15 of the implement 10 using a number of wing nuts 44, also called threaded fasteners, and a U-bolt which isn't visible in the figure however which U-bolt straddles the main handle 15 and cooperates with the attaching means 40 and the wing nuts 44 to clamp the auxiliary handle assembly 20 to the implement 10.

This manner of attachment where one end of the auxiliary handle 20 is attached to the implement 10 is called cantilevered by the inventors, and includes single-end pivotal and pinned connections to the implement and the like with the appropriate configuration of the connecting means 40.

In this preferred embodiment, the auxiliary handle assembly 20 is of unitary construction and is shown as an integral one-piece molding made of a thermoplastic such as injection molded polyethylene, preferably, or polypropylene, though other materials and forming processes may be suitable, including vinyls, nylons, thermoforming, blow-molding, metal or plastic sheet stampings, component pieces of sheet metal or wire, composite moldings, or combinations and assemblies of these.

The auxiliary handle assembly 20 includes the elongate member 35 having a first end 36, which is interchangeably considered to be 36', and also called a free end or handle end, and a second end 37 which is considered to include and be associated with the attaching means 40. The elongate member 35, being resilient and torsionally flexible and bendable between the first end 36 and the second end 37, responds to the forces from the user's arm and wrist movements and selectively transmits the lifting and wrist and arm rotational and motion forces exerted on the hand grip portion 32 associated with the first end 36 from the first end 36 to the second end 37 and to the connection with the implement 10 at the attaching means 40.

The fashion of motion of the hand grip portion 32 and the elongate member 35 from the bending and torsion in the auxiliary handle assembly 20 from motion and forces typically exerted by the user is shown generally by the drawing dotted line portion and the directional arrows 47*a* through 47*e*.

Arrow 47*a* depicts motion of the auxiliary handle assembly 20 towards and away from the main handle 15. Arrow 47*b* depicts motion laterally or crosswise to the main handle 15. Arrow 47*c* depicts rotation of grip hand portion 32, as do 47 d and 47*e*, though 47*d* and 47*e* can also represent regions or zones of flexible response for hand grip portion 32 depending on their relative configurations.

Notice in the dotted line drawing that the elongate member 35 can move laterally to one side of the implement or the other as indicated by the arrow 47*b* while the working head 30 remains level.

Notice also that rotation of the hand grip portion 32 depicted by the directional arrows 47*c* through 47*e* has substantially no effect on the orientation of the working head 30 relative to the ground.

These results are useful because a user needn't exercise particular care in holding the hand grip portion 32 and can adopt body postures of their choosing and comfort without adversely affecting the task of shoveling because the hand grip portion 32 is free to move without affecting the rotation and the orientation of working head 30 with respect to the ground. This performance character and mechanism is a particularly astonishing, interesting, and useful detail of this invention.

The reason for this performance is due to the warping and oil-canning-like fold-over effect of the bend in the bend region of the auxiliary handle assembly 20 which allows the elongate portion to change direction due to the uneven radii of curvature of bending in the bending zone.

The ability to twist the hand grip portion 32 and to move it laterally to the side is desirable for shoveling or transporting materials without prematurely dumping the load 78 and without the user taking special care in how the hand is positioned over the implement to prevent dumping the load 78. For vegetation trimmers, such performance provides freedom of wrist and arm motion without inducing a rotation of the trimmer and thereby aids ergonomics and prevents inadvertently trimming the vegetation too close, causing unsightliness and hazardous discharge of debris.

Locations marked 5, 6, 7, 8 indicate areas of notable cross section in elongate member 36 and correspond to Figures FIG. 5, FIG. 6, FIG. 7, and FIG. 8 respectively to aid the structural and operational description without limiting the invention to a particular cross section's illustrated shape-specific configuration, position along the elongate member's length, or sequence, though the arrangement shown here is useful and so is considered important. Each marked location and its corresponding cross section is representing generic characteristics at various points in elongate member 35 as it relates to torsionability, bendability, and rigidity which arise from the cross section configuration. Areas adjacent to these cross sections can be thought of and considered to be zones or segments or regions or portions having characteristics similar to that represented by the cross section. For some locations the areas adjacent a particular cross section may represent a transition between such zones, or may be part of a zone that is intentionally configured using its cross sections to change its characteristics over its length. An example would be a zone of bending which gets stiffer the farther one moves from a cross section which allows bending to occur. Another example would be a zone which transitions between two zones having different relative characteristics. The zones' relative lengths and order sequencing and degree of characteristics is variable and is configured by a product designer depending on the performance characteristics desired in consideration of the customer, implement, and job task characteristics.

Location 5 marks a sample cross section through the attaching means 40 of the elongate member which for this configuration is representing, and intended to be, substantially rigid. Location 6 marks a sample cross section through a region or zone where bending is possible. Note that in this embodiment torsion in this zone is also possible, the mechanics of such is notable and is related to the changeable and uneven radii explained earlier. Location 7 marks a sample cross section through the elongate member representing a cross section where the elongate member is longitudinally substantially rigid or non-bendable yet is torsionally flexible, though for this configuration of auxiliary handle assembly it is not a requirement for this portion to be torsionally flexible Too, the figure here is not intended to show a required shape-specific configuration, spatial relationship, or sequence per say, yet is merely intended to show one possible configuration of segments without limiting the invention to such.

A hand grip portion 32 is associated with the first end 36 for grasping by a user and for imparting a user's lifting force to the first end 36 and thereby to an attaching means 40 associated with the second end 37. The attaching means 40 provides for adjusting the entire auxiliary handle assembly 20 along the main handle 15 in the direction of arrows 48*a* and 48*b* to accommodate for user's height or preference. The elongate member 35 is designed to be self supporting so it will return to a normal at-rest position adjacent to the main handle 15 of the implement 10 if released during use.

In this figure and configuration the elongate member 35 is unitary and considered to be comprised of a series of cross sections which together give it its flexing and torsion characteristics along its length. In a way, to discuss one way of looking at the invention without limiting the invention to such a description, the elongate member could be considered to be comprised of a plurality of substantially thin walled profiles or cross sections, particularly in the areas where bending or torsion are desired or encouraged. As well, without limiting similarly, it is notable that in this embodiment the bending is taking place in a region which could be called substantially flat prior to bending, and or of substantially rectangular cross section—particularly during the time when bending is beginning or in the process of taking place. Taken together these cross sections comprise a series or a plurality of torsional and bendable and rigid zones, or zones having advantageous combinations of these characteristics, which arise from the configuration of these cross sections.

These zones can provide useful combinations of characteristics, such as torsion and no bending, or bending with torsion as depicted within elongate member 35 at locations 7 and 6 respectively.

Accordingly, in this figure, and residing in sectional zone location marked 6, is a zone having primarily a rectangularly shaped cross section and sectional envelope enabling and suitable to bending flexure of the elongate member 35 in that region. As well, the region between 36 and the nearest edge of zone location 6 is a substantially rigid section owing to its cross section, namely for this figure, a C-channel-like shape which resists bending yet not torsion. As well, it is notable that once bending has begun, torsion of the grip member 36 results in oil-canning-like flexing of the bend zone thereby allowing the bending region to dissipate or accommodate the flex and torsion action through flexure motion of the bend zone and allowing the grip to further twist without affecting mounting 40, and thereby avoiding the transfer of twisting forces to shovel blade 30, preventing the dumping of the load 78 in response to twisting and motion of the grip portion 32. Though not shown, it is notable that the addition of a varying thickness or a variation in cross sectional shape in this region, such as by adding ribs or holes, would enable a degree of control over the characteristics of bending in this region by the product designer to achieve product performance goals suitable to the product task.

Figure 8:
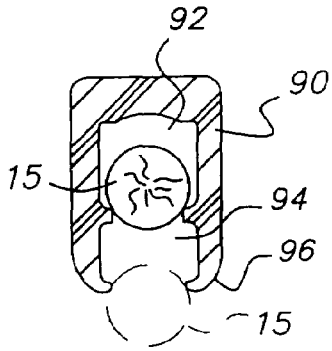
FIG. 8 is a cross sectional view of the multiple positions retaining member.
Figure 13:
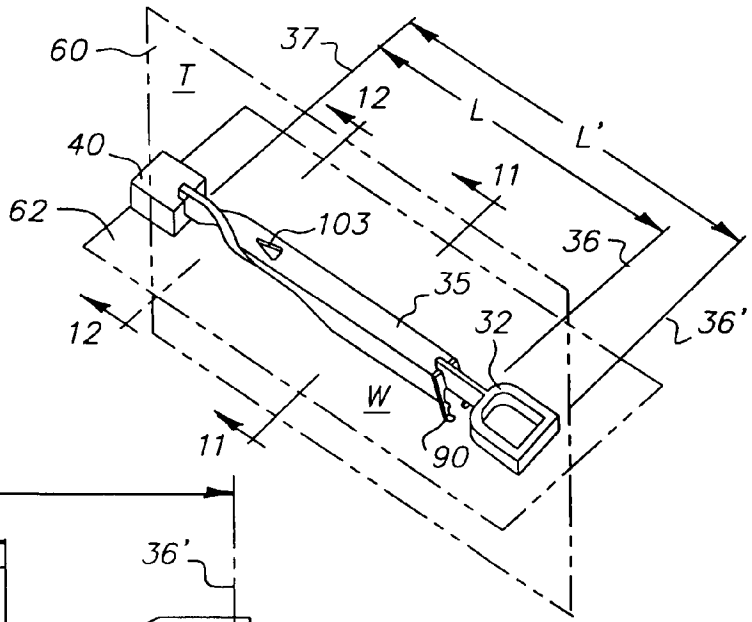
FIG. 13 is a perspective view of the invention's descriptive model.

Also shown is an optional, but useful multi-positions retaining clip 90, also called a 3-position clip or clip or retaining clip or retaining member, is shown integrally molded and is further described in other figures, and is best viewed in FIG. 8. It is noted that the most preferred embodiment clip is one oriented at an angle to the elongate member as best depicted in FIG. 10*a* and FIG. 13, different from the orientation shown here, though the one shown here in this figure is functionally effective.

This lateral action (of the grip) is a natural user motion for a user interacting with auxiliary handles, yet heretofore not possible without causing rotation in the implement unless complex swivel mechanisms are used which require the user to balance the load and continuously hold onto the grip handle.

Note also that the orientation of the bending region tends to provide lateral stability of the implement 10 just by holding the hand grip 32, and arising from the width of the section, its bent shape, and the non-rotating connection means 40 about the primary longitudinal axis of the main handle 15.

Figure 4:
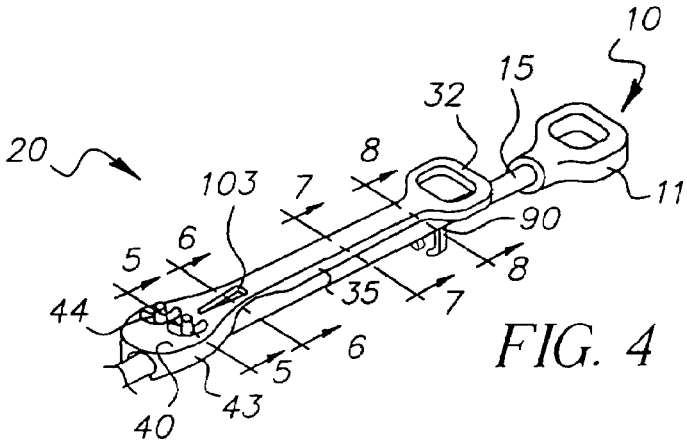
FIG. 4 is a partial ¾ view of an embodiment of the flexible auxiliary handle having an aperture in a region which flexes.
Figure 6:
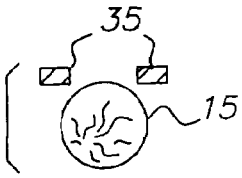
FIG. 6 is a cross sectional end view of the elongate member in a region suited for bending.
Figure 7:
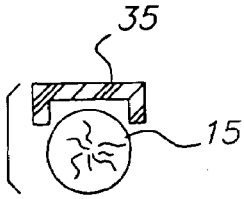
FIG. 7 is a cross sectional end view of the elongate member in a region suited for simultaneous longitudinal rigidity and torsional flexibility.
Figure 5:
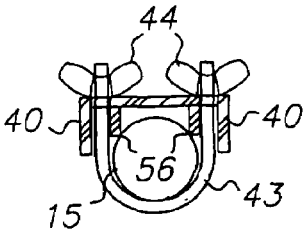
FIG. 5 is a cross sectional end view of the elongate member through a rigid portion occurring at the attaching means.

FIG. 4 shows various parts of auxiliary handle assembly 20 including sectional locations seen in FIG. 5, FIG. 6 and FIG. 7 and one means of securely attaching the elongate member to the main handle 15 of the primary unit 10 which includes a U-bolt 43 and nut assembly, as shown, with the wing nuts 44.

FIG. 5 depicts a preferred attaching means 40, where the elongate member 35 and the attaching means 40 are integrally formed and associate with the U-bolt 43 and the nut assembly using the wing nuts 44, which secure the attaching means 40 to the main handle 15 of the primary unit 10 along two lines of contact 56. Other hardware could be used. An advantage of utilizing the wing nuts 44 is that a user can install and adjust the position of the auxiliary handle 20 without using tools and often without having to remove gloves.

The two line contact 56 has an advantage in rigidly securing the second end 37 of the elongate member 35 to the main handle 15 so as to prevent swiveling and yaw. If yaw or swiveling were present the elongate member 35 would not be consistent in returning the associated hand grip portion 32 to close proximity to the main handle 15, at times referred to as a main shaft or rigid handle 15, when the hand grip portion 32 is released at numerous times during use. It has been found desirable that the longitudinal length of the line of contact should be at least equal to the physical width between the lines of contact 56 shown in FIG. 5.

FIG. 6 shows a cross section through 6-6 of FIG. 4. It is perhaps easy to comprehend why this cross section would longitudinally bend more easily than that shown in FIG. 7. The sectional shapes might be of any configuration that will serve the purpose of influencing the bending characteristics of the elongate member 35. For example, crescent shaped, circular, or parts thereof as in FIG. 21, FIG. 22, and FIG. 23, and the like. The configuration of FIG. 6 has been found to encourage bending laterally or to the side as well as upward as a result of an aperture 103 which is shown as one of the means to influence flexing and bending of the elongate member 35 when placed under stress from a load as the grip portion 32 is moved away from the main handle 15. This aperture effect on bending is also discussed later when FIG. 19 to FIG. 26 are described.

One of the many advantages this invention offers is the ability to control the degree of flexing and bending through structural shape, material selection and related factors to separately control bending in one or more directions with the aim of giving the user better control of the hand manipulatable tool or implement 10 while reducing the total effort required for work and reducing the risk of strain to the user's wrist and back.

Figure 9:
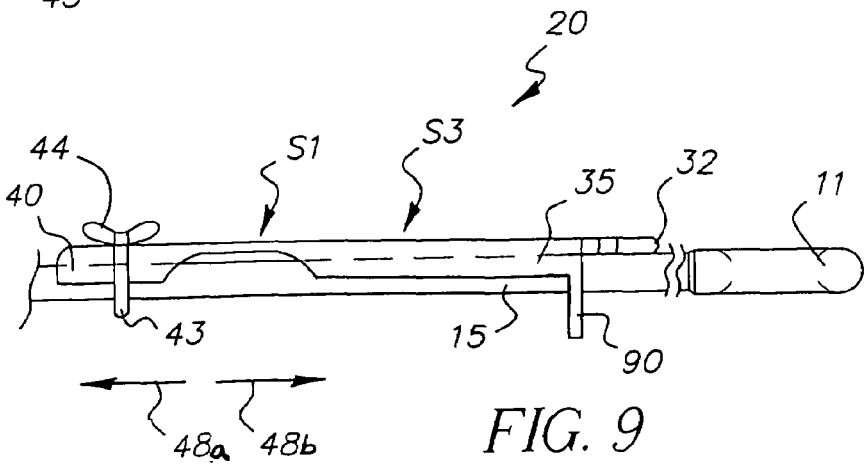
FIG. 9 is a side view of FIG. 4 showing the elongate member having segments advantageously configured to have different combinations of bending and torsion characteristics.

FIG. 9 is a side view of FIG. 4. and serves to introduce the concept of the elongate member 35 being composed of various types of segments advantageously having different bending characteristics. FIG. 6 and FIG. 7 represent segment types S1 and S3 respectively. It can be seen that type S1 would be more easily bent than S3 which is shown in FIG. 7. A further description of these appears later.

FIG. 8 shows the multiple positions retaining member 90 associated with or in proximity to the hand grip portion 32 for securing the elongate member 35 to the main handle 15 in a storage retention hole 92 for firm retention and long time storage. A light retention hole 94 is for light retention and for temporary holding of the elongate member 35 and is configured to space the hand grip 32 a slight distance apart from the main handle 15 for making the hand grip portion 32 easier to grasp and remove from retention. The dashed line represents a third position of the multiple positions retaining member 90 where it rests on top of the main handle 15 thereby placing the hand grip 32 within even closer grasp of the user's hand and requiring the user 5 to bend or reach less or not at all in order to grasp the hand grip 32 again after release. Often to rapidly reacquire the handle, the user 5 will quickly and instinctively and ever-slightly raise the handle 11 of the primary unit 10 to bring the hand grip 32 closer to the user's grasping hand for easier grasping.

It is noted that it is preferable to have retention legs 96 tapered narrower in profile and tapered thinner in thickness near the ends of the retention legs 96 and to provide an oblique beveled impinging-aiding surface at those leg locations which contact the main handle 15 so to facilitate simultaneous outward and axially twisting deflection of the retention legs 96 to facilitate the starting of the impingement of the multiple positions retaining member 90 on the main handle 15. The combined effect and action is pleasantly surprising and unexpected and facilitates the achievement of the actions for retention and light retention described above. It has been observed that the multiple positions retaining member 90 even as shown and impinging upon the main handle 15 orthogonal to the main handle surface, and having a flat plate like aspect, that the retention legs surprisingly and usefully tend to torque and twist about their respective axis to slip onto the main handle 15.

The multiple positions retention member 90 also serves yet another purpose. When the user 5 is installing the auxiliary handle assembly 20 onto the shovel implement 10, or transferring it to the new hand held tool 10, by first securing the multiple positions retention member 90 onto the main handle 15 the auxiliary handle 20 maintains its position on the main handle 15 and thereby making easier the installation of the fastening means of the attaching means 40, which otherwise might be awkward.

Note also that an angled orientation of the multiple positions retention member 90 would tend to have an installation-facilitating frictional locking and impinging action on the main handle 15 should the auxiliary handle 20 try to slip down the main handle 15 due to gravity prior to the fastening of the attaching means 40. Such is just one of the reasons for having the multiple position retention member 90 at an angle to the elongate member 35. Such locking effect of the angle, it is believed, is also operating when the multiple positions retention member 90 is used as intended to retain the elongate member 35 when it is oriented to impinge at an angle to the main handle 15, and is based on the general performance observed, despite such clip-function at-first seemingly having a somewhat different impinging operating aspect relative to the gravity-based impinging observed during installation.

When the hand grip portion 32 is released so that the user 5 can push a light snow from a position behind the shovel implement 10 the user 5 may in the process give the main handle 15 a series of quick thrusts while gathering the snow and thereby causing the elongate member 35 to swing forward then back repeatedly with the hand grip portion 32 striking the main handle 15 with annoying sounds. The multiple positions retaining member 90 cushions the sound and if the swing is moderately firm the multiple positions retaining member 90 will latch around the primary handle 15 with a light retention and thereby prevent further swinging. A very hard and quick push may result in the multiple positions retaining member 90 latching into the storage retention hole 92, where it is still easily removed.

The multiple positions member 90 may contain one or more than the two retention holes 92 and 94 shown. It is also possible, and would be quite practical, to mold the multiple positions retention member 90 within the confines of the hand grip member 32 as indicated and suggested by the dashed outline in FIG. 27 and FIG. 28 where the entire auxiliary handle assembly 20 is shown integral with the working head 30 of the hand manipulatable implement 10.

Such molding within the hand grip portion 32 could produce a breakaway part for hardware mounting or a snap fit mounting, or if molded flat, could include a living type of hinge associated with an integral locking latch or suitable fastener.

The multiple positions retention member 90, as shown in FIG. 31, can also be associated with an adjustable length configuration of the auxiliary handle assembly 20, shown in FIG. 29 that includes a first section L1 where the section L1 is shown integral with the working head 30. The angled connection of the multi-position clip 90, as shown in FIG. 29 and FIG. 31, makes it possible to mold the retention member 90 without having to use mold slides to create the retention holes 92 and 94. Angling serves yet another purpose, namely, to cause the opposing leg portions 96, to rotate as they flex apart to allow passage of the main handle 15 into the retention holes 92 and 94. It has been found desirable to provide oversize holes to accommodate variations in size of the main handle 15, and so not induce continual stress during long term storage.

FIG. 9 is a side view of the auxiliary handle assembly 20 shown in FIG. 4. The attaching means 40 can be repositioned along the main handle 15 by loosening the wing nuts 44 and sliding the auxiliary handle 20 in the direction of arrows 48*a* or 48*b*, and then retightening the wing nuts 44 without the need f or tools, and for the purpose of accommodating users of differing heights or preferences. Other fasteners could be used too, as well as alternate means for attaching could be employed, such as, but not limited to those shown in FIG. 15 to FIG. 18.

In addition, FIG. 9 introduces a concept of having various segments, such as the segments S1 and S3 shown in the drawing, to indicate the relative bending characteristics of the elongate member 35 at such segments, which is more fully described below.

Each segment has its own length and has bending characteristics as a result of the combination of the shape, structure and material chosen, plus other factors, including the segment's distance from where a user would grasp the hand grip portion. What is important is the combination of all factors in determining the total effect of such factors on the flexibility, resiliency and bendability in one direction when compared to the orthogonal direction.

FIG. 10*a* through FIG. 13 first establish that the elongate member 35 conceptually has a thickness T forming a first plane 60 and a width W forming a second plane 62 which is orthogonal to the first plane.

As used herein, the thickness T, and the width W are, by our definition, related to the bendability (or equivalently, flexibility) of the elongate member 35 within a particular general plane and direction as defined above and by the depictions in the referenced figures FIG. 10*a* through FIG. 13, and thus the values of T and W are not the conventionally thought of physical thickness or width of a structure belonging to the elongate member 35, but representation of the structure's relative ability to bend in the respective planes and directions which T and W represent.

This concept is then used with respect to sections which may make up the elongate member to represent the segment's relative ability to bend, or not bend, in a particular plane and direction, and the relative assemblage of which sections into a sequence and each having differing responses for bending in T and W to make up the elongate member 35 and greatly affect the tendency for the elongate member 35 bend in T or W as a whole for accomplishing a useful or desired bending outcome such as for creating the elongate member 35 as the flexible auxiliary handle 20.

Another point to be noted and which may aid understanding is that while a segment may have the same physical dimensional values as another, depending upon its orientation within the elongate member 35 and its position from the hand grip 32 and the forces that would be applied the hand grip 32, the segment's bending characteristics and overall contribution to the overall character of performance of the auxiliary handle assembly 20 may be very different.

Referring to FIG. 10*a* may help illustrate this concept and show a condition where the physical dimensional values of the segments remain the same yet where the bending characteristic for each is different and varies with, and is dependent on, the relative values of the thickness T and width W which are associated with that segment due to its orientation within the elongate member (along with the other details mentioned previously).

Such T and W characteristics are typically determined by product designers by their choice of cross section, sequence, etc., to create a useful overall effect. The descriptive process explained here is merely meant to provide a convenient means to describe how a segment behaves for bending in a particular plane and direction in order to establish some representative sections which can be relied on in discussions rather than as an attempt to create a technical conundrum. Further, this explanation merely illustrates one way of thinking and speaking about the characteristics associated with the representative segments S1, S2, S3, S4, and S5, and what can be considered to be important about them in a technical sense.

In the illustrations provided in FIG. 10*a* though FIG. 13, and progressing for a distance starting from the attaching means 40 at segment S2 and generally progressing stepwise to each subsequent labeled segment towards hand grip 32 in FIG. 10*a* it will appear that T and W change drastically and transpose each other in relative value such that they may seem to appear to transpose values or change places or character. Note that the segments are identical in cross section and that it's orientation of the cross section which is causing the T and W values to change and will be more readily seen below. As well, the example is illustrative of the values of T and W which we associate with each of the segments for describing the inventive model.

Figure 12:
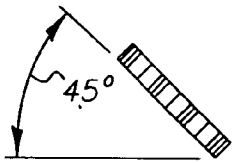
FIG. 12 is a cross sectional view of the descriptive model's elongate member in a region that represents one possible transition between segments.
Figure 11:
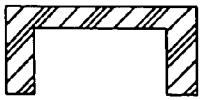
FIG. 11 is a cross sectional view of the descriptive model's elongate member in a region that is semi-rigid relative to bending or flexing.
Figure 10B:
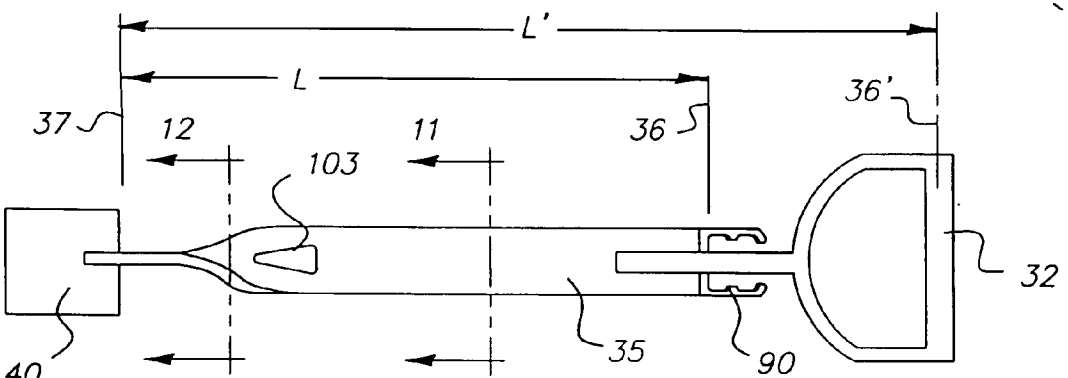
FIG. 10*b* is a top view of the descriptive model of the invention.
Figure 10A:
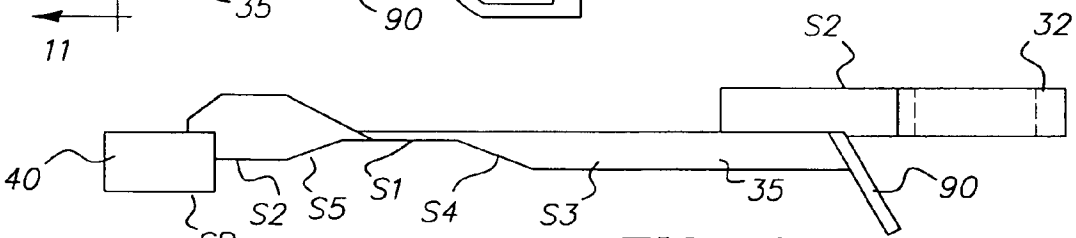
FIG. 10*a* is a side view of the descriptive model of the invention.

Referring to FIGS. 10*a* and 10*b*, by our definition, the relative value for thickness T in the illustrated model (near the second end 37 coincident with the segment S2) starts with a high resistance to bending value, transverses through a 45 degree rotation at a mid point as represented by FIG. 12, where the relative value of T and W would be equal, to finish at a point adjoining segment S1 in FIG. 10*a* where T would now have a low value for representing its resistance to bending. The member has the same physical dimensions but very different values depending on orientation.

As best seen in FIG. 10*a* the elongate member 35 has a length L, (or length L' if the grip handle portion is less than substantially rigid or is indeterminately rigid), that can be viewed as comprising multiple segments, S1, S2, S3, S4, S5. Each segment of the multiple segments advantageously has different relative values of thickness T and width W for bending and flexing relative to the two planes 60 and 62 as previously described.

FIG. 10*a* is side view of a general model of the invention illustrating five types of segments which can be described as follows: Segment S1, shows where T has a relative value less than W for encouraging bending and flexing of segment S1 substantially in a first plane 60 and away from the second orthogonal plane 62 when equal lifting and sideways stress is applied to the first end 36 of the elongate member 35.

In reality, and actual practice, stresses of equal value for lifting and sideways stress applied evenly and simultaneously would not occur very often owing to the customary mode of use of such auxiliary handle devices. However, such description of the action is accurate and helpful for evaluating how to go about determining or thinking about a segment's classification and is also useful if the description were used to create a test method for determining segment classification where the same stress level was placed one at a time on a segment in each of the 2 orthogonal planes and directions to allow evaluation of bending character for each of the 2 directions represented by T and W to help determine the direction of bending that is encouraged by any particular segment. Thus the phrase, "equal lifting and sideways stress," though a bit awkward in concept and effective practical matter, will continue to be used and without further mention with such considerations in mind.

Segment S2, shows where T has a relative value greater than W, for encouraging bending of segment S2 substantially in the orthogonal plane 62 and away from the first plane 60 when equal lifting and sideways stress is applied to the first end 36 of the elongate member 35.

Segment S3, is where T and W are about equal in value, for encouraging substantially equal resistance to flexing and bending of segment S3 away from either plane. Normally this results in a semi-rigid portion of the elongate member.

Where T and W are both substantial it results in a section designated as SR being substantially rigid and inflexible. Segments 1, 2, 3, 4 and 5, each have an unbiased or starting position prior to the application of stress from the hand grip portion, and are each twistable and torsionally responsive in yielding and transmitting torque in varying degrees upon application of stress, and where applicable likewise for bending, whereby in either case, torsion or bending, they are substantially returning to the unbiased position when the stress is released.

Segment S4 indicates a transition taking place within the segment, and between two adjacent segments, where the relative value of T and W and or the structural profile shape of the segment are changing over the longitudinal axis of the segment. This is best seen upon inspection of this segment S4 in the side view of FIG. 10*a* where S4 performs the transition between adjacent sections S1 and S3. It may be helpful to refer to FIG. 10*b* to fully comprehend what is taking place. An S4 segment or transition may, but does not have to, include a change of segment type. Particularly, it would appear unwise to design a transition from S1 to S2 without having an S3, S4 or S5 intermediate section or the structure would be subject to breaking at a relatively small or abrupt juncture at their interface. Another useful example of the S4 section is near the grip portion 32 of FIG. 10*a* where section S2 overlays elongate member 35.

Segment S5 consists of a 90 degree preformed twist that is bendable in two orthogonal directions and is usually employed intermediate between an S1 and an S2 section, or vice versa. The twist may occur in either direction. More than one segment S5 may occur within the length L of the elongate member 35. For example, an S5 section is best seen in FIG. 10*b* and FIG. 13 as shown near the second end 37. Such a section S5 could be located near the first end 36 as an alternate section to the section S2. In this location both S2 and S5 perform a similar function to provide means for the hand grip portion to tip as well as twist and to yield to the user's natural wrist movements. Other advantages may be subsequently described.

FIG. 10*b* and FIG. 13 show an aperture 103 and which purpose is to influence the bending characteristics of the elongate member 35 during loading. It is also utilized in FIG. 4 in which the triangular shape will encourage bending to start in the vicinity of the triangle's base, so as the load increases, the sharpest part of the bend would move toward the triangle's apex, where there is more material to resist bending and the bending radius thereby will be less severe and the load manageably supported by the section.

A similar concept could be performed by tapering longitudinal ribs, or by a thickening cross section within the region of the bend where thicker material is closer to the connection means within the zone of bending to accomplish the same purpose of bending control.

In these figures the multiple positions clip 90 is shown at an angle as a reminder that it could be molded integral with the elongate member 35 without the need for shutoff slides in the mold as previously mentioned. Furthermore, the angle facilitates warpage of the retention legs 96 also called standoff legs, for impinging the multi positions clip 90 onto the main handle 15, much like swinging double doors yet subtly and less obvious than such might first appear. As well, this angle aids in disengaging the multi positions clip 90 from the main handle 15 as well as onto it thus resulting in user convenience while providing a secure retention. Too, an angled orientation provides a pleasing mechanical dynamic retention effect and pleasing audible feedback when the clip is engaged and disengaged, such that the operation of it, unlike other retention clips, produces sound like the pleasing thunk-sound upon closing the passenger door on a well made automobile. As well, the appearance of such is pleasing and provides a progressive and streamlined look of a modern consumer product. Finally this angle provides the opportunity for cost effective integral molding, and enables viability of such angle including clip designs to replace those not currently compatible with the retail environment due to stacking/nesting issues and incidental damage due to the typical 90-degree orientation of such retaining devices interacting negatively with their environment and due to customer handling. This angled design is expected to receive little to no damage in retail environments, and provides customer appeal due to their pleasing appearance when nested in a floor display box and or on retail hang pegs, and when installed engaged on the customer's equipment.

Figure 14A:
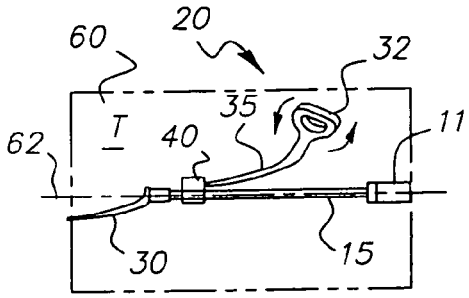
FIG. 14*a* is a side view showing the descriptive constructs of the first plane 60 and the second plane 62.

FIG. 14*a* is a side view showing the first plane 60 and the second plane 62. The auxiliary handle assembly 20 is secured by the attaching means 40 to the main handle 15 of the primary implement 10 having the working head 30. The auxiliary handle assembly 20 is depicted as though a user has imparted a twisting motion to the elongate member 35 causing it to twist and change the relative value of T and W in a manner as illustrated by FIG. 12. This allows the hand grip portion to move away from plane 60 as shown in top view 14*b*. Without the elongate member being torsionally twistable the hand grip portion 32 would have tended to remain substantially within plane 60, yet would depend greatly on the configuration and characteristics of the section S1 allowing bending in plane T.

This move away from plane 60 is also possible without twisting by moving the handle sideways thereby causing an oil-canning or warp effect or differential bending radii within section S1 which then provides the displacements needed at the lower portions of the elongate member within S1 to allow the handle to move sideways, though the result is accomplished more readily if a slight twist is imparted, and which twist is a natural unconscious motion, and hence given the typical implement working loads and motions involved, intentional twisting is largely not a factor of particular concern.

As well, if desired, bending and torsional performance can be engineered to provide some desired level of resistance to bending when the hand grip remains non-twisted or is twisted by some desired amount based on market preferences. This is why the elongate member 35 is considered in the manner outlined herein where the configuration of the segments relative to the whole can be used to achieve the desired performance goals.

Figure 15:
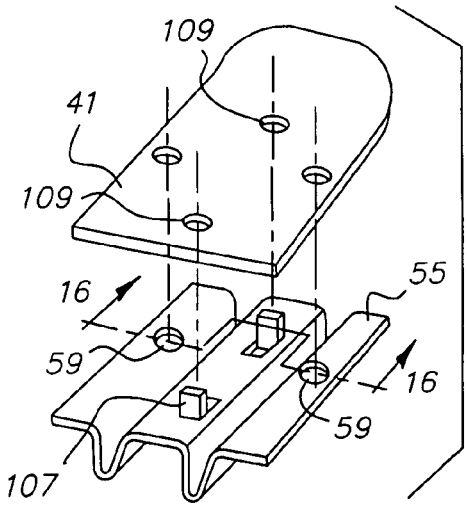
FIG. 15 is an exploded view of the structural parts of a W style mounting means.
Figure 16:
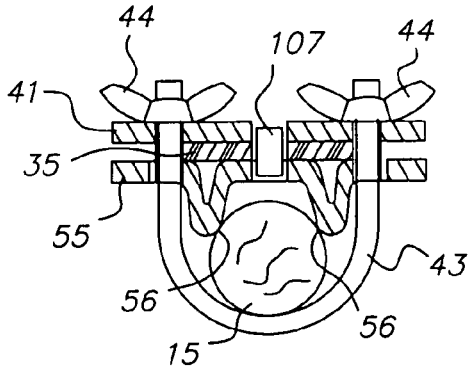
FIG. 16 is a section view of a W style mounting saddle.

FIG. 15 and FIG. 16 show one method for providing adjustment to the length of the elongate member 35 and therefore the location of the hand grip portion 32 relative to the primary tool 30. A set of tabs 107 are designed to cooperate with a plurality of holes in the elongate member 35 (not shown in FIG. 15): The holes are placed over the tabs 107 at the desired position and a pressure plate 41, also called a top plate, is placed to form a sandwich so that the tabs 107 protrude through the flexible web 35 and then into the holes 109 to securely capture, in a sandwich like configuration, the elongate member 35 and secure it to the main handle 15 of the primary implement 10 using the U-bolt 43 and the wing nuts 44. It is recognized that variations on this concept such as the elongate member 35 having bosses which protrude into the saddle 55 or the top plate 41, and variations thereof, are possible.

Notice also that two lines of contact 56 are provided by the shape of a W-shaped saddle 55. Notice also that such configurations would be suitable for a wide variety of users' implements' diameters for the main handle 15. It is noted that almost any formation of commonly strong metal which provides a series of ribs or rails of orientation and spacing and aspect shown for this line contact purpose would be useful. Further, the same, yet made of a durable molded plastic such as glass-filled polypropylene or high density polyethylene or nylon would improve manufacturability, customer appeal, and reduce implement weight.

Notice that the pressure plate or top plate 41 also serves the purpose or function to minimize the potential for an acute angle of bending of the elongate member during lifting and use by the provision of an upward facing curve portion in the pressure plate 41 as shown in FIG. 15. As well it is noted that this pressure plate could be made of plastic or metal and configured to provide some flexure to act as a shock absorber during auxiliary handle use and would be useful in preserving the elongate member 35 longevity and increasing its maximum load carrying capacity. Special shapes or curvature could also be provided in alternative to the curve shown to advantageously manage loading. As such, the top plate 41 is considered important.

The combination of the top plate 41 and the saddle 55 or its equivalents, as a means for attaching the auxiliary handle assembly 20 and for managing lift forces on a flexible auxiliary handle, in this case the elongate member specifically, is considered important.

Figure 17:
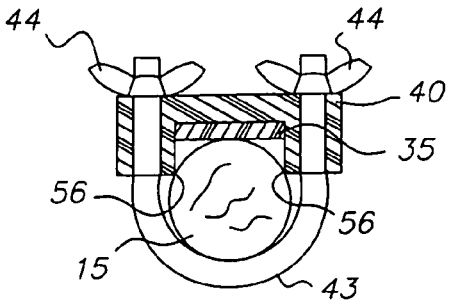
FIG. 17 is a section view of a compression style saddle mount.
Figure 18:
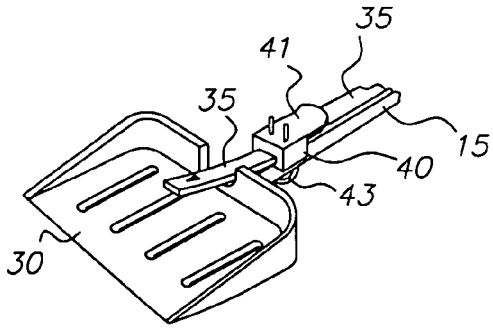
FIG. 18 is a perspective view of an impinging type elongate member length adjustment.

FIG. 17 and FIG. 18 show another method for adjusting the length of the elongate member 35. The elongate member is impinged between the attaching means 40 and the main handle 15. Cooperating fish-scale surfaces on the upper surface of the elongate member 35 and on the underside of the attaching means 40 would help insure a secure attachment. Notice the slight upward tip at the front edge of the pressure plate 41. As mentioned, this is a useful means to control excessive bending. Other means for controlling bending are shown in FIG. 19 through FIG. 23. There are several reasons why it is desirable to be able to control the degree of bending that occurs in the elongate member 35 as it is placed under stress as in lifting a load. First, the continual flexing involving sharp bends will weaken the part and risk breakage. Another reason: too sharp a bend and the member may permanently or plastically bend and perhaps not be resilient enough to return to the unstressed state. A very sharp bend near the attaching means could also make it difficult to load snow with a sweeping action as depicted in FIG. 2.

Figure 19:
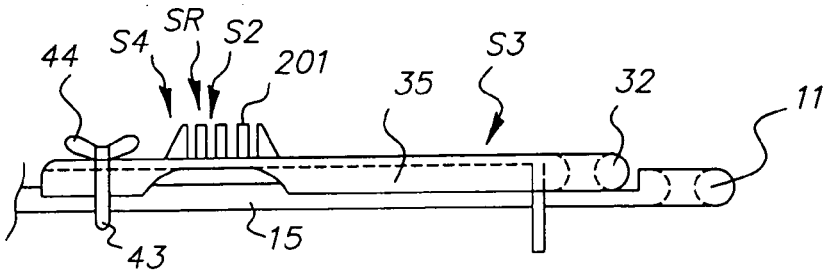
FIG. 19 is a side view of a method for controlling the bending radius using a plurality of transverse ribs.
Figure 20:
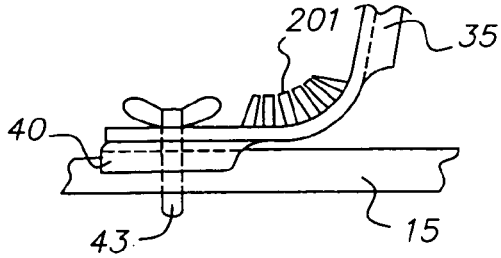
FIG. 20 is a side view of the bending action for the method of controlling the bending radius using a plurality of transverse ribs.

FIG. 19 shows a method of controlling the bending radius (and allowing for lateral grip motion) comprised of a plurality of transverse ribs 201, each one constituting a substantially rigid segment SR, followed by a bendable segment type S1 which permits bending flexure in the first plane 60 away from the main handle of the implement so that when the elongate member 35 is placed under stress, as shown in FIG. 20, the ribs 201 will impinge on each other and therefore control the bending radius. Examining the structure of the elongate member 35, it can be seen that each rib 201 constitutes a substantially rigid SR segment followed by a bendable segment S1. Each segment has its own length. The length of each segment, in cooperation with the plurality of segments and the physical height of each rib 201 result in being able to control the bending radius of the elongate member 35 as well as the amount of arc freely traveled before all the ribs 201 have impinged. Applying continued stress would then cause the adjoining semi rigid segment S3 to flex and bend and thereby not place undue strain on the segments S1.

For snow shovel applications it is suggested that the total free travel be limited to approximately 50 degrees. When the main handle 15 of the shovel implement 10 is held vertical the elongate member 35 may fall forward the mentioned 50 degrees, however, as the main handle 15 is brought into a position for use at about 35 degrees from vertical the result is that the hand grip portion 32 would be just 15 degrees off vertical and still be within a user's easy grasp. In this way the auxiliary handle 20 can fall forward a certain amount during use yet remain within easy grasp since it is kept from falling too far forward and out of the reach of the user.

Figure 21:
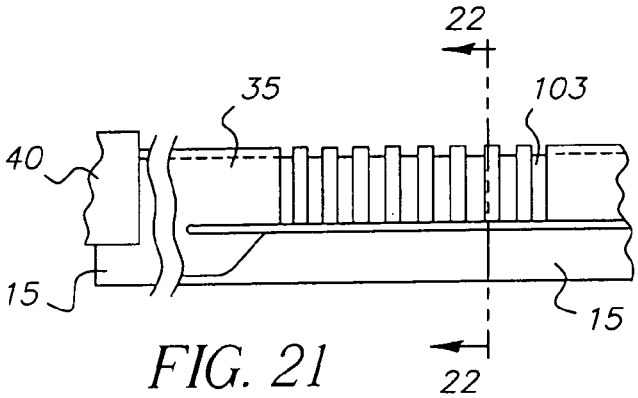
FIG. 21 is a side view of a method for controlling the bending radius and achieving a low profile using a plurality of apertures in the elongate member.

FIG. 21 gives an example of an extremely low profile configuration very similar to FIG. 19 and FIG. 20, yet which controls bending by using a plurality of apertures 103 in the elongate member 35. As can be seen in sectional view in FIG. 22 the shape and configuration would constitute a substantially rigid segment SR followed by a segment S1 resulting in bending control like that previously described for FIG. 19 and FIG. 20 with added advantages; the low profile makes it easy to grip the main handle 15 in a normal manner while the auxiliary handle assembly is in place; it provides the ability to more easily twist the elongate member (see also FIG. 6 showing a similar aperture 103 which facilitates bending); too, it aids transmission of pushing forces from the hand grip 32 to the attaching means 40 owing to the downforce transmitted successively edgewise through the flange portion of the plurality of the sections S1 and SR, the flange being depicted in FIG. 22. and also seen in the side view of FIG. 21 and FIG. 23.

Figure 22:
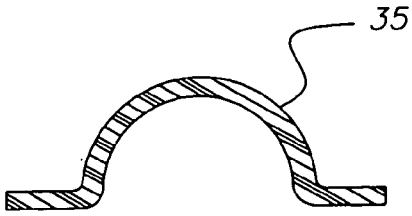
FIG. 22 is a section view of a substantially rigid portion of the elongate member shown in FIG. 21.
Figure 23:
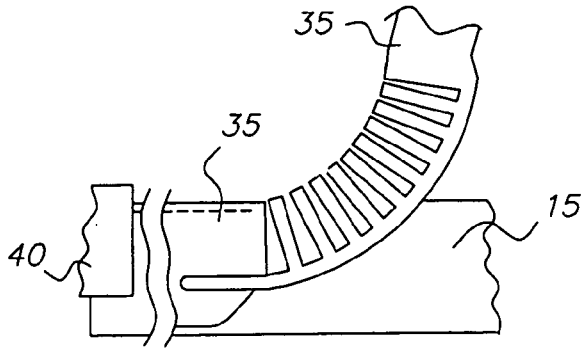
FIG. 23 is a side view of the bending action for the method of controlling the bending radius using a plurality of rigid sections and apertures.

The substantially rigid SR profile shown in FIG. 22 with the last appropriate SR section is intended to continue toward the first end 36 of the elongate member 35 and the associated hand grip portion 32. Note that while the substantially rigid segment SR would not be flexible or bendable it still would be torsionally flexible, and thereby would still yield and be responsive to the user's wrist movements without causing strain while allowing directional control forces to be transferred to the mounting.

Figure 24:
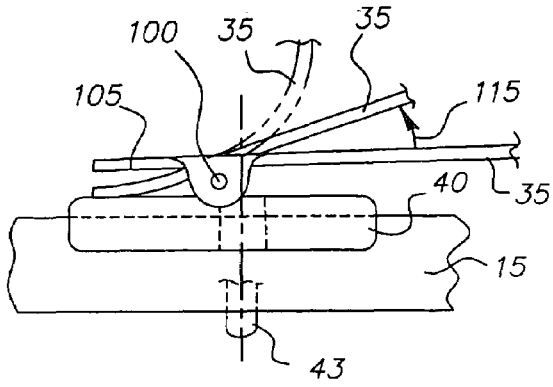
FIG. 24 is a side view showing an alternate pivot mount using a saddle style mount, u-bolt, and wing nuts.
Figure 25:
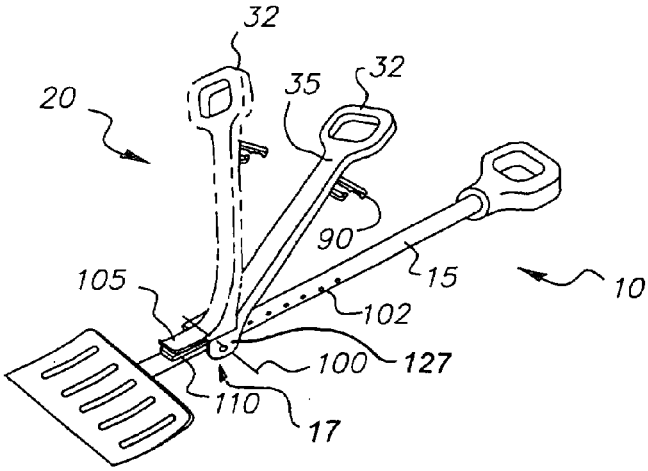
FIG. 25 is a ¾ view of a pivotal flexible web and a pivot pin securing the invention using holes in the rigid handle of the primary unit.

FIG. 24 shows yet another means to control the degree of bending of the elongate member 35 in an impinging manner having similarities with the two means just described in FIG. 19 through FIG. 23. In this case bending is limited by allowing the elongate member 35 to rotate some distance before bending begins which arises from contact with the attaching means 40 and works as follows: the attaching means 40 receives a pivot pin 100 to secure the elongate member 35 rigidly to the attaching means 40 and, the elongate member 35 having a tang 105 positioned to permit the elongate member 35 to freely pivot some distance as stress is applied in an arc in the plane 60 away from the main handle 15 in the direction of arrow 115 until the tang 105 makes contact with the attaching means 40, the tang 105 starts to resiliently flex. As bending continues the tang 105 acts as a stop (as shown in FIG. 25) where continued stress causes the elongate member 35 to flex to a position depicted by the dashed line images. In this manner the degree of bend can be controlled to enable the hand grip portion 32 to return to an unstressed position adjacent to the main handle 15. It is recognized that other elements for contact for the tang 105, such as the main handle 15, may equivalently be used to perform such bend control actions. Notice that the tang 105 is integrally molded and may take geometric form other than shown here though its function remains the same. Likewise, the tang 105 could be a snap-on or add-on part of metal or plastic or other suitable material.

FIG. 25 shows the auxiliary handle assembly 20 having a pivot yoke attaching means 17 integrally molded with the elongate member 35 and having a plurality of pivot ears 127 which straddle the main handle 15 and are configured to receive the pivot pin 100 for attaching the elongate member 35 to the main handle 15 of the primary unit 10, using any one of the plurality of holes 102 in the main handle 15. The functioning of the elongate member 35 and the tang 105 is the same as described for FIG. 24.

Figure 26:
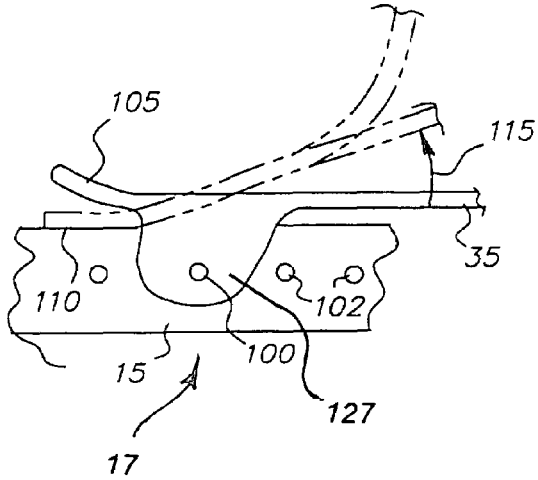
FIG. 26 is a detail side view of FIG. 25 showing limited pivoting prior to flexing of the flexible web.

FIG. 26 shows a detail view of the elongate member 35, the pivot yoke attaching means 17 integrally molded with the elongate member 35 and having the pivot ears 127, the tang 105, the plurality of holes 102, and the main handle 15 used as described in FIG. 25.

FIG. 27 shows the auxiliary handle assembly 20 and the working head 30 integrally formed that includes a means 240 for attaching the main handle 15 of the hand manipulatable implement 10, which includes the elongate member 35 and the hand grip portion 32 which further associates with the multi positions retaining member 90.

The dotted outline of the retaining member 90 is meant to convey that it was integrally formed with the grip portion 32 and connected to it by a continuous or discontinuous living hinge and which the retaining member 90 folds down using such hinge for securing the retaining member 90 into a usable orientation by fasteners or integrally molded snap features which cooperate with corresponding elements of the grip portion 32 or the elongate member 35. However, retaining member 90 could have been formed in final use place as previously described, or have been formed separately and attached by snap fit. Such separately formed configuration would allow the use of a different material for the retaining member 90 should it be necessary for durability or other reason. Likewise it is recognized that the retaining member 90 could be likewise be incorporated by one of the manners just described into the hand grips for auxiliary handles already common to the marketplace to useful advantage. An example of such industry standard hand grip which could benefit from including the retaining member 90 by methods just described and heretofore unknown is shown in the Sims U.S. Pat. No. 5,704,672. The incorporation of the retaining member 90 by such means for such handles would be useful to auxiliary handle inventions in general, as it would for Sims, and thereby may constitute a useful means to economically produce and provide such.

Figure 14B:
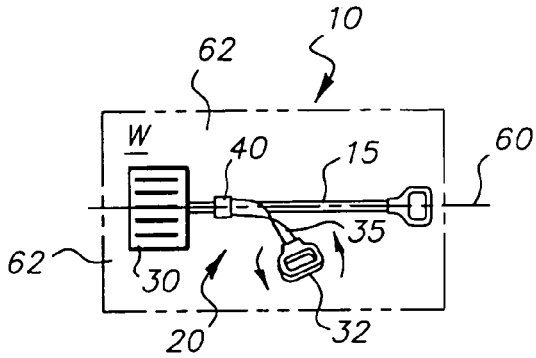
FIG. 14*b* is a top view showing the descriptive constructs of the first plane 60 and the second plane 62.

This FIG. 27 also illustrates an elongate member that is designed to bend substantially in the first plane 60 and with twisting, bendable away from the plane 60 as best seen in FIGS. 14*a* and 14*b*.

FIG. 28*a* is a ¾ view representing an integral composition combining the working head 30, and the elongate member 35, the attaching means 240 to secure the main handle 15, the hand grip portion 32, and the multiple positions retaining member 90 in an unfolded position. The elongate member 35 includes a large "A" shaped aperture adjoining the working head 30. This configuration lacks means to make adjustment to the hand grip portion 32 position. The elongate member 35 could be configured like FIG. 31 to provide for adjusting the hand grip 32 location.

FIG. 28*b* is a side view of 28*a* further illustrating four of the different segments that relate to the relative ease of bending and directions of least resistance to bending and flexure; segment S1 being bendable away from the main handle 15, segment S2 being bendable in the orthogonal direction (to either side); segment S3 offering about equal resistance to bending in either plane, and segment S4 representing a transition between two adjoining segments. Not shown is segment S5 which represents a transition involving a 90 degree pre-formed twist for the most common purpose of connecting a segment S1 to a segment S2.

Figure 32:
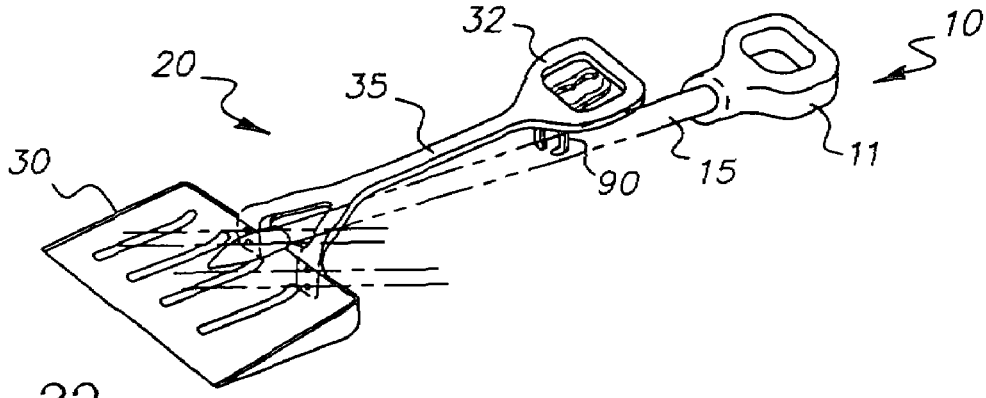
FIG. 32 is a perspective view showing a method for attaching the auxiliary handle assembly 20 to the working head by fasteners or suitable adhesive.

FIG. 29 Illustrates a means to adjust the length of the flexible web 35 when a section L1 of the elongate member 35 has been integrally formed to associate with the working head 30 or attached by means shown in FIG. 32, or any other suitable means. A separate section, L2 of the elongate member 35 is designed to adjustably overlap the section L1 and be secured by any appropriate means.

FIG. 30 is a side sectional view of the hand grip portion 32 that incorporates means for attaching to the elongate member 35 which itself is configured to receive the adjustable hand grip portion 32 as shown in FIG. 31. In studying FIG. 30 and FIG. 31 it should be apparent that the hand grip portion 32 may be installed with an upward orientation (as shown) to provide clearance for inserting the hand by the user 5 for grasping, or may be installed flat for shipping as shown by the non-solid lines in FIG. 30.

FIG. 31 shows the hand grip 32 attached to the elongate member 35 of the auxiliary handle 20 by any suitable hardware Again, a variation could include the attaching means described in FIG. 30 and FIG. 31.

FIG. 32 illustrates a means for attaching the auxiliary handle assembly 20 to the working head 30 of the hand held hand manipulatable implement 10 by fasteners suitable for the task. In this way a manufacturer could incorporate mounting holes or features to receive the auxiliary handle assembly 20 for installation by the user 5.

Reviewing this figure further it can be seen alternatively that the mounting tangs shown for use with fasteners could be configured and extended further and shaped to conform to the surface of the working head 30 and suitably configured to allow the use of aggressive adhesive tapes such as 3M®'s Very High Bonding or VHB™ tapes to attach the auxiliary handle assembly 20 to the working head 30 by the original equipment manufacturer (OEM), or possibly by the customer.

Such adhesive bonding approach can be combined with mechanical fasteners as well to much benefit including, eliminating play or looseness between components, act as or create a reinforcing means by creating a bonded layer assembly where failure must now overcome a larger area, act to increase the total load bearing capability of the junction due to addition of adhesive shear strength which is very strong, act as a safeguard against sudden breakage failures. Such adhesive bonding approach could also be used to attach mounting means directly to the implements or their tools for mounting auxiliary handles by such means as pivot mounts, snap bosses, collars, and the like. Benefits would include rapid assembly time, fewer parts, and lighter weight. Such adhesives can also be used to join components together which then act as mounting means rather than attaching them directly to the implement itself, an example might include joining two halves or perhaps the ends of a collar that then acts as a swivel. Such brand tapes and adhesives it is understood are very durable in varied loading and climate conditions and are used to connect large-scale outdoor highway signage to their support structures without the use of fasteners during their useful life, and are finding their way into mainstream application.

Figure 33:
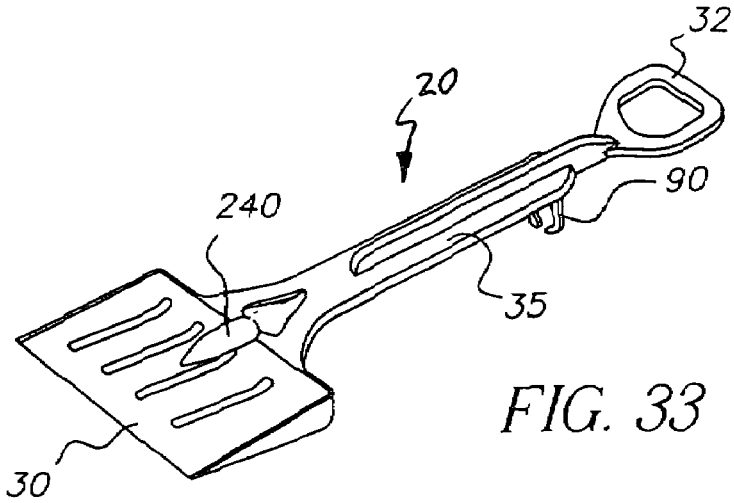
FIG. 33 is a ¾ view showing the auxiliary handle assembly 20 integrally connected to the working head 30 which includes the means 240 to accept a main handle.

FIG. 33 shows a compilation of the auxiliary handle assembly 20 integrally connected to the working head 30 which includes the means 240 to accept the main handle 15 of a primary tool. In this view the retaining member 90 is integrally molded into its useable position.

Examples used heretofore have consistently shown shovels as examples of implements, however, the auxiliary handle assembly 20 could as easily be attached or made integral with, for example, the motor housing of a hand manipulatable powered implement, such as a vegetation trimmer. It is also possible that the auxiliary handle assembly 20 (in a view not shown) could be integrally connected to or formed with the main handle 15 of the primary implement 10, such as with a plastic molding. It is also recognized that the pivotal auxiliary handle assembly invention of FIG. 25 could likewise be pivotally attached by appropriate cooperating means directly to the working head 30 of the implement 10. As well, it is recognized and has also been found that the invention described herein is useful for use with ordinary bent handled backsaver shovels which suffer from dynamic load imbalances due to the line of shoveling actions occurring well above the shoveled load.

Figure 34:
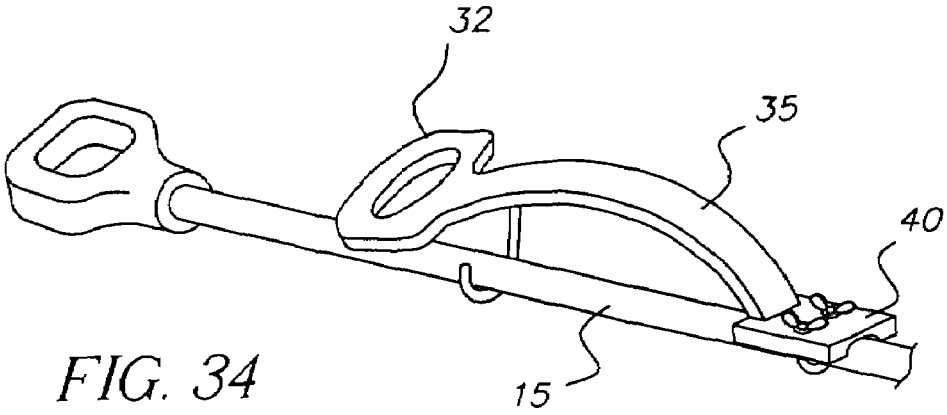
FIG. 34 is a ¾ view of an auxiliary handle assembly having a pre-formed curve introduced into elongate member 35 for controlling bending radius.

FIG. 34 illustrates a pre-formed curve introduced into elongate member 35 arising from the oblique orientation of the second end 37 of the elongate member 35 relative to the attaching means 40 for the purpose of limiting the amount of bending flexure of the elongate member 35 at the attaching means 40 to reduce the bending range of motion required of the elongate member 35 for effective use.

Having thereby described the subject and matters of this invention, it should be apparent that many substitutions, modifications, and variations of the invention are possible in light of the above teachings. It is therefore understood that the invention as taught and described herein is limited only to the extent of the breath and scope of the claims.

We claim:

1. An auxiliary handle assembly for a hand held and hand manipulatable implement having a main handle and a working head, comprising:

(a) an elongate member having a first end and a second end, said elongate member being flexible and bendable for effectively transmitting lifting force from the user's wrist from said first end to said second end;

(b) a grip portion associated with said first end for grasping by a user and for imparting a user's wrist forces to said first end; and (c) an attaching means associated with said second end for operatively attaching said second end to one of said main handle and said working head of said hand held and hand manipulatable implement;

wherein said elongate member includes at least one bendable portion having a linear length and two movable ends and having a substantially rectangularly shaped cross section between said first end and said second end and wherein a centerline joining the moveable ends of said bendable portion extends along said linear length in a direction from said elongate member first end towards said working head for enabling the formation of a localized bending region within said elongate member whereby said localized bending region substantially facilitates the ability of said first end to move relative to said second end, and;

wherein between said two movable ends said lengthwise centerline is further comprising a first lengthwise centerline portion adjacent to a movable end of the bendable portion closest to said first end of said elongate member and a second lengthwise centerline portion adjacent to a movable end of the bendable portion closest to said second end of said elongate member, wherein said second lengthwise centerline portion is positioned substantially non-orthogonal with said main handle during the formation of said localized bending region and wherein said localized bending region substantially facilitates the ability of said first end to move relative to said second end.

2. The auxiliary handle assembly of claim 1, wherein said elongate member and said grip portion comprise a single, integrally formed piece.

3. The auxiliary handle assembly of claim 1, wherein said elongate member and said grip portion comprise a single, integrally molded piece.

4. The auxiliary handle assembly of claim 1, wherein said elongate member and said grip portion are each made of a plastic material chosen from an ethylene family of plastic material.

5. The auxiliary handle assembly of claim 1, wherein said grip portion is substantially more rigid than said elongate member so as to enable and to fully impart the user's wrist forces to said elongate member.

6. The auxiliary handle assembly of claim 1, wherein said grip portion as associated with said first end has no motion relative to said first end, thereby enabling said first end to effectively receive the user's wrist forces as imparted to said first end of said elongate member.

7. The auxiliary handle assembly of claim 1, wherein said attaching means as associated with said second end has no motion relative to said second end, thereby enabling effectively transmitting the user's wrist force from said first end to the main handle of the hand held and hand manipulatable implement.

8. The auxiliary handle assembly of claim 1, wherein said attaching means comprises a pivot mount and a pivot pin for securing said second end to the main handle of the hand held and hand manipulatable implement.

9. The auxiliary handle assembly of claim 1, wherein said attaching means comprises a U-bolt and nut assembly.

10. The auxiliary handle assembly of claim 1, wherein said attaching means comprises a mounting saddle.

11. The auxiliary handle assembly of claim 1, including a multiple positions retaining member associated with said first end of said elongate member for temporarily retaining said first end and said grip portion onto the main handle of the hand held and hand manipulatable implement in anyone of multiple retaining positions.

12. The auxiliary handle assembly of claim 1, wherein said attaching means is comprised of a W-shaped saddle for providing line contact mounting at a point of attachment with said implement.

13. The auxiliary handle assembly of claim 1, wherein a relative orientation of a length of said localized bending region between moveable ends of said localized bending region and a length of a remainderpart of said elongate member proximate thereto are substantially similar to each other.

14. The auxiliary handle assembly of claim 1, wherein said bendable portion and said localized bending region are approximately equal in length for creating a localized bending in said elongate member and in said auxiliary handle.

15. The auxiliary handle assembly of claim 1, wherein a length of said bendable portion is greater than a length of said localized bending region for creating a localized bending in said elongate member and in said auxiliary handle.

16. The auxiliary handle assembly of claim 1, wherein one of the thickness and the width of said bendable portion is substantially in one plane and substantially equal in length to said elongate member and wherein said localized bending region is proximate said second end.

17. The auxiliary handle assembly of claim 16, wherein said second end is one of rigidly and pivotally retained.

18. The auxiliary handle assembly of claim 1, wherein said bendable portion is substantially flat and is substantially equal in length to said elongate member and wherein said localized bending region is proximate said second end.

19. The auxiliary handle assembly of claim 1, wherein said localized bending region is associated with said second end and forms arcuate shapes having widely varying values for bending radii with a displacement and motion of said first end relative to said second end, and whereby said widely varying values for bending radii substantially facilitate the motion of said first end relative to said second end.

20. The auxiliary handle assembly of claim 19, wherein said arcuate shapes substantially facilitate the movement of said first end relative to said second end in a direction transverse to a length of said localized bending region.

21. The auxiliary handle assembly of claim 1, wherein substantive material parts of said localized bending region form arcuate shapes having widely varying values for bending radii with displacement and motions of said first end relative to said second end and wherein said widely varying values for bending radii substantially facilitate the motion of said first end relative to said second end.

22. The auxiliary handle assembly of claim 21, wherein bending radii associated with lateral material parts of said localized bending region are relatively similar in value during displacement and motions of said first end relative to said second end.

23. The auxiliary handle assembly of claim 21, wherein bending radii associated with lateral material parts of said localized bending region differ in relative value during displacement and motions of said first end relative to said second end.

24. The auxiliary handle assembly of claim 23, wherein said change in relative values of said bending radii substantially facilitates the movement of said first end relative to said second end in a direction transverse to the length of said localized bending region.

25. The auxiliary handle assembly of claim 21, wherein bending radii associated with lateral material parts of said relatively localized bending region dynamically change in relative value with motions of said first end relative to said second end.

26. The auxiliary handle assembly of claim 1, wherein said localized bending region includes lateral material parts forming arcuate shapes having differing and varying bending radii relative to each other with the motion of said first end relative to said second end, and whereby said differing and varying bending radii of said lateral material parts facilitate an ability of said first end to move relative to said second end in a direction transverse to a length of said relatively localized bending region.

27. The auxiliary handle assembly of claim 26, wherein values of said bending radii vary widely and substantially facilitate movement of said first end relative to said second end in a direction transverse to a length of said localized bending region.

28. The auxiliary handle assembly of claim 1, wherein said elongate member and said grip portion comprise a single, integrally molded piece formed from a material selected from a polyethylene family of material.

29. The auxiliary handle assembly of claim 1, wherein said elongate member and said grip portion comprise a single, integrally molded piece formed from a material composition including polyethylene.

30. The auxiliary handle assembly of claim 1, wherein said bendable portion is associated with said second end.

31. The auxiliary handle assembly of claim 1, wherein said bendable portion is associated with said first end.

32. The auxiliary handle assembly of claim 1, wherein one of the thickness and the width of said bendable portion is substantially in one plane.

33. The auxiliary handle assembly of claim 1, wherein said bendable portion is substantially flat.

34. The auxiliary handle assembly of claim 1, wherein said bendable portion is comprised of a substantially inelastic material.

35. The auxiliary handle assembly of claim 1, wherein a length of said bendable portion is relatively short as compared to a length of said elongate member and is associated with said second end.

36. The auxiliary handle assembly of claim 35, wherein said bendable portion is oriented for bending towards and away from said main handle.

37. The auxiliary handle assembly of claim 35, wherein said bendable portion is oriented for bending crosswise relative to said main handle.

38. The auxiliary handle assembly of claim 1, wherein the predetermined overall length of said auxiliary handle is approximately 8 inches long to approximately 30 inches long.

39. The auxiliary handle assembly of claim 1, wherein said elongate member is comprised of two fixedly repositionable overlapping length members for adjusting an overall length of said auxiliary handle from said first end to said second end.

40. The auxiliary handle assembly of claim 1, wherein said grip portion is fixedly repositionable along the length of said elongate member for adjusting a position and distance of said grip portion relative to said second end for obtaining a desired performance character.

41. The auxiliary handle assembly of claim 1, wherein said bendable portion is comprised of a resilient material.

42. The auxiliary handle assembly of claim 1, wherein said bendable portion is comprised of a metallic material.

43. The auxiliary handle assembly of claim 1, wherein said bendable portion is comprised of a thermoplastic material.

44. The auxiliary handle assembly of claim 1, wherein said bendable portion is comprised of a thermoplastic material selected from a polyethylene family of thermoplastics.

45. The auxiliary handle assembly of claim 1, wherein said elongate member includes at least one pre-twisted portion having at least one flexibly bendable end.

46. The auxiliary handle assembly of claim 1, wherein a cross sectional profile of said bendable portion varies over a length of said bendable portion so as to modify a character of bending of said bendable portion.

47. The auxiliary handle assembly of claim 1, wherein said bendable portion includes a length portion having longitudinal ribs so as to modify a character of bending of said bendable portion.

48. The auxiliary handle assembly of claim 47, wherein said longitudinal ribs include a tapering aspect so as to modify a character of bending of said bendable portion.

49. The auxiliary handle assembly of claim 1, wherein said bendable portion includes a length portion having a thickening cross section so as to modify a character of bending of said bendable portion.

50. The auxiliary handle assembly of claim 1, wherein said bendable portion includes an aperture for modifying a character of bending of said bendable portion.

51. The auxiliary handle assembly of claim 1, wherein said bendable portion comprises a plurality of apertures formed therethrough.

52. The auxiliary handle assembly of claim 1, wherein said bendable portion includes impinging ribs for advantageously modifying a bending character of said bendable portion.

53. The auxiliary handle assembly of claim 1, wherein said elongate member is comprised of substantially thin-walled cross sectional profiles.

54. The auxiliary handle assembly of claim 53, wherein said thin-walled cross sectional profiles contribute to an ability of said first end to torsion relative to said second end.

55. The auxiliary handle assembly of claim 1, wherein said elongate member is comprised of multiple components.

56. The auxiliary handle assembly of claim 1, wherein said elongate member is a composite molding including at least one thermoplastic piece.

57. The auxiliary handle assembly of claim 1, wherein said elongate member is comprised of a single piece.

58. The auxiliary handle assembly of claim 57, wherein said elongate member is comprised of a metallic material.

59. The auxiliary handle assembly of claim 57, wherein said elongate member is comprised of a resilient material.

60. The auxiliary handle assembly of claim 57, wherein said elongate member is comprised of a thermoplastic material.

61. The auxiliary handle assembly of claim 57, wherein said elongate member is comprised of a material composition including polyethylene.

62. The auxiliary handle assembly of claim 57, wherein said elongate member is comprised of a material selected from a polyethylene family of materials.

63. The auxiliary handle assembly of claim 1, wherein said elongate member includes a relatively rigid non-bending length portion associated with said first end and said bendable portion associated with said second end for providing a freedom of motion for said first end and an improved ability to directionally control said implement in a ergonomic and cost effective fashion.

64. The auxiliary handle assembly of claim 63, wherein said relatively rigid non-bending length portion is comprised of a substantially thin-walled cross sectional profile having at least one substantial channel like shaped region for creating a light weight non-bending member for transmitting at least one of lifting and directional control forces from said first end towards said second end.

65. The auxiliary handle assembly of claim 64, wherein said channel like shaped region is substantially arcuate.

66. The auxiliary handle assembly of claim 64, wherein said channel like shaped region is substantially comprised of a plurality of linear elements.

67. The auxiliary handle assembly of claim 64, wherein said channel like shaped region is approximately rectangular in shape.

68. The auxiliary handle assembly of claim 64, wherein said non-bending length portion facilitates torsion between said first end and said second end.

69. The auxiliary handle assembly of claim 64, wherein said non-bending length portion is substantially non-torsionable.

70. The auxiliary handle assembly of claim 64, wherein said non-bending length portion is comprised of thermoplastic.

71. The auxiliary handle assembly of claim 64, wherein a portion of said main handle is able to lie within an interior portion of said channel like shaped region during one of storage and while using said implement in a conventional manner for creating advantage in storage space reduction and ergonomics and aesthetics.

72. The auxiliary handle assembly of claim 64, wherein said elongate member is attached to said working head.

73. The auxiliary handle assembly of claim 1, wherein said elongate member is comprised of a single piece and includes a relatively rigid non-bending length portion associated with said first end and said bendable portion associated with said second end for providing a freedom of motion for said first end and an improved ability to directionally control said implement in a ergonomic and cost effective fashion.

74. The auxiliary handle assembly of claim 73, wherein said elongate member is integrally formed with said grip portion.

75. The auxiliary handle assembly of claim 73, wherein said elongate member is integrally formed with said grip portion and with a portion of said attaching means.

76. The auxiliary handle assembly of claim 73, wherein said relatively rigid non-bending length portion is comprised of a substantially thin-walled cross sectional profile having at least one substantial channel like shaped region for creating a light weight member for transmitting at least one of lifting and directional control forces from said first end towards said second end.

77. The auxiliary handle assembly of claim 76, wherein said cross sectional profile is substantially arcuate.

78. The auxiliary handle assembly of claim 76, wherein said cross sectional profile is approximately rectangular.

79. The auxiliary handle assembly of claim 76, wherein said cross sectional profile substantially facilitates torsion of said first end relative to said second end.

80. The auxiliary handle assembly of claim 76, wherein said grip portion is integrally formed with said elongate member.

81. The auxiliary handle assembly of claim 76, wherein a portion of said main handle is able to lie within an interior portion of said channel like shaped region during one of storage and use of said implement in a conventional manner for creating advantage in storage space reduction and ergonomics and aesthetics.

82. The auxiliary handle assembly of claim 76, wherein said elongate member integrally includes a portion of said attaching means.

83. The auxiliary handle assembly of claim 76, wherein said elongate member is integrally formed with said working head.

84. The auxiliary handle assembly of claim 1, wherein said elongate member is comprised of a thermoplastic material and includes an elongate relatively rigid non-bending length-portion for providing an improved ability to direct forces from said first end towards said second end, thereby enhancing control of motions of said hand manipulatable implement in a cost effective manner.

85. The auxiliary handle assembly of claim 1, wherein said elongate member is comprised of a thermoplastic material and includes a relatively rigid non-bending length portion associated with said first end and said bendable portion associated with said second end for providing a freedom of motion for said first end and an improved ability to directionally control said implement in a reliable and cost effective fashion.

86. The auxiliary handle assembly of claim 1, wherein said elongate member is comprised of a thermoplastic material composition including a thermoplastic material selected from a polyethylene family and having a relatively rigid non-bending length portion associated with said first end and said bendable portion associated with said second end for creating an auxiliary handle assembly possessing advantageous ergonomic dynamic characteristics and directional control and durability in service.

87. The auxiliary handle assembly of claim 1, wherein said elongate member is comprised of a material selected from a polyethylene family and having a relatively rigid non-bending length portion associated with said first end and said bendable portion associated with said second end for creating an auxiliary handle assembly possessing advantageous ergonomic dynamic characteristics and directional control and durability in service.

88. The auxiliary handle assembly of claim 1, wherein said second end is attached to said working head of said hand manipulatable implement.

89. The auxiliary handle assembly of claim 88, wherein said working head is a blade of a shovel.

90. The auxiliary handle assembly of claim 88, wherein said working head is a housing of a vegetation trimmer.

91. The auxiliary handle assembly of claim 1, wherein said second end is integrally molded with said working head of said hand manipulatable implement.

92. The auxiliary handle assembly of claim 91, wherein said working head includes means for accepting said main handle.

93. The auxiliary handle assembly of claim 91, wherein said working head is a blade of a shovel.

94. The auxiliary handle assembly of claim 91, wherein said working head is a housing of a vegetation trimmer.

95. The auxiliary handle assembly of claim 1, wherein said second end is integrally molded with said main handle of said hand manipulatable implement.

96. The auxiliary handle assembly of claim 1, wherein said attachment means includes adhesives for joining said second end to at least one of said main handle and said working head.

97. The auxiliary handle assembly of claim 96, wherein said attaching means conforms to the shape of said working head.

98. The auxiliary handle assembly of claim 96, wherein said attaching means includes mechanical fasteners.

99. The auxiliary handle assembly of claim 1, wherein said attaching means includes cooperating joining features between said second end and said working head.

100. The auxiliary handle assembly of claim 1, wherein said second end is rigidly retained and said elongate member is resiliently bendable in at least one direction of directions towards and away from said main handle and crosswise to said main handle.

101. The auxiliary handle assembly of claim 100, wherein a rigid retaining means includes a saddle-like portion providing line contact to said attaching means for clampingly engaging said hand manipulatable implement.

102. The auxiliary handle assembly of claim 101, wherein said retaining means includes a threaded u-shaped fastener for clampingly engaging said hand manipulatable implement.

103. The auxiliary handle assembly of claim 102, wherein said saddle like portion includes a surface for creating line contact.

104. The auxiliary handle assembly of claim 102, wherein said saddle like portion includes rib-like features for creating line contact.

105. The auxiliary handle assembly of claim 100, wherein said second end includes an integrally formed saddle-like portion for providing line contact for said attaching means to clampingly engage said hand manipulatable implement.

106. The auxiliary handle assembly of claim 105, wherein said saddle-like portion and said second end are comprised of a resilient material such as thermoplastic.

107. The auxiliary handle assembly of claim 105, wherein said saddle-like portion and said second end are comprised of an inelastic material such as sheet metal.

108. The auxiliary handle assembly of claim 105, wherein said saddle-like portion is made integral by a composite fabrication with said second end, such as by molding a thermoplastic in contact with portions of a metallic component.

109. The auxiliary handle assembly of claim 1, wherein said second end is pivotally retained and said elongate member is resiliently bendable in at least one plane of planes towards and away from said main handle and crosswise to said main handle.

110. The auxiliary handle assembly of claim 109, wherein said second end integrally includes a hole for said pivotal retaining means.

111. The auxiliary handle assembly of claim 110, wherein said elongate member is a molding.

112. The auxiliary handle assembly of claim 110, wherein said elongate member is created by a forming process.

113. The auxiliary handle assembly of claim 110, wherein said integral pivot hole is formed as a composite molding of materials.

114. The auxiliary handle assembly of claim 109, wherein when said second end includes a tang for limiting a range of motion of said pivot.

115. The auxiliary handle assembly of claim 1, wherein said auxiliary handle is substantially self supporting and wherein a configuration of said auxiliary handle with said bendable portion and with said attaching means limits free motion of said grip portion to approximately 50 degrees of forward rotation relative to said main handle.

116. The auxiliary handle assembly of claim 115, wherein said attaching means comprises one of rigid, pivot, and angular orientation relative to said second end.

117. The auxiliary handle assembly of claim 1, wherein said bendable portion enables said auxiliary handle to be self supporting when said hand manipulatable implement is held in a position proximate to vertical.

118. The auxiliary handle assembly of claim 1, wherein when said second end is rigidly retained, said elongate member is resiliently bendable in a direction towards and away from said main handle.

119. The auxiliary handle assembly of claim 1, wherein when said second end is pivotally retained, said elongate member is resiliently bendable in a direction crosswise to said main handle.

120. The auxiliary handle assembly of claim 1, including a restraining member overlaying an unsupported free-length portion of said bendable portion for modifying at least one of a character and a stress of said bending.

121. The auxiliary handle assembly of claim 120, wherein said elongate member is bendable towards and away from said main handle.

122. The auxiliary handle assembly of claim 120, wherein said restraining member comprises a top plate.

123. The auxiliary handle assembly of claim 120, wherein said restraining member includes a curved portion for contacting said bendable portion for modifying at least one of a character and a stress of said bending.

124. The auxiliary handle assembly of claim 120, wherein said restraining member causes said bendable portion to flex about a point of contact therewith.

125. The auxiliary handle assembly of claim 120, wherein said restraining member includes a flexible portion.

126. The auxiliary handle assembly of claim 1, wherein one of said grip portion and said elongate member includes a retaining clip integrally formed therewith.

127. The auxiliary handle assembly of claim 126, wherein said clip is formed in a position ready for use.

128. The auxiliary handle assembly of claim 126, wherein said clip is formed in a first position and is foldable into a second position for use.

129. The auxiliary handle assembly of claim 126, wherein said clip is removable from a first position for manufacture on one of said grip portion and said elongate member and is redeployable into a second position for use on one of said grip portion and said elongate member for accomplishing an economy in production and handling of said retention clip and a relative freedom and economy in clip design.

130. The auxiliary handle assembly of claim 129, wherein said redeployment action includes a snap fit.

131. The auxiliary handle assembly of claim 126, wherein said clip is formed in a position proximate the interior opening of said grip portion.

132. The auxiliary handle assembly of claim 131, wherein an orientation of said retaining clip is ready for use.

133. The auxiliary handle assembly of claim 131, wherein said clip is removable from a first position for manufacture on one of said grip portion and said elongate member and is redeployable into a second position for use on one of said grip portion and said elongate member for accomplishing an economy in production and handling of said retention clip and a relative freedom and economy in clip design.

134. The auxiliary handle assembly of claim 131, wherein said clip is formed in a first position and is foldable into a second position for use.

135. The auxiliary handle assembly of claim 134, wherein the process of said folding includes a locking latch.

136. The auxiliary handle assembly of claim 126, wherein said clip is substantially planar and includes elongate flexible legs.

137. The auxiliary handle assembly of claim 126, wherein said clip is deployed for use at an angle other than 90-degrees to one of said grip portion and said elongate member.

138. The auxiliary handle assembly of claim 126, wherein said clip is integral to one of said grip portion and said elongate member as a composite fabrication wherein said clip is comprised of a different material from one of said grip portion and said elongate member.

139. The auxiliary handle assembly of claim 1 wherein a first centerline portion located at a junction between said elongate member and said bendable portion at said junction that is associated with a lengthwise centerline located along said bendable portion between the movable ends of said bendable portion is substantially parallel to a second centerline portion at said junction that is associated with a lengthwise centerline along said elongate member.

140. The auxiliary handle assembly of claim 1 wherein a lengthwise centerline between the movable ends of said bendable portion is substantially parallel to a lengthwise centerline of said elongate member.

141. The auxiliary handle assembly of claim 1 wherein a lengthwise centerline between the movable ends of said bendable portion and a lengthwise centerline associated with said elongate member substantially extend toward said working head.

142. The auxiliary handle assembly of claim 1 wherein a lengthwise centerline between the movable ends of said bendable portion and a lengthwise centerline associated with said elongate member are substantially parallel and extend toward said second end.

143. An auxiliary handle for use with a hand manipulatable implement having a main handle and a tool portion at one end of said main handle, comprising:

(a) an elongate member assembly having a first end and a second end, said elongate member assembly including:

(i) an elongate and substantially rigid non-bending length portion associated with said first end for directing and transferring forces from said first end towards said second end;

(ii) at least one linear-length bendable portion having movable ends and having substantive parts of said linear-length bendable portion parallel to and located to either side of a lengthwise centerline between the movable ends of said bendable portion forming discernable and arcuate shapes having differing and varying bending radii relative to each other in response to displacements and motions of said first end relative to said second end and whereby said linear-length bendable portion and said bending radii substantially enable said first end to move relative to said second end in at least one preferential plane of motion; and (b) a grip portion associated with said first end for grasping by a user and for imparting motion and control forces to said first end; and (c) an attaching means associated with said second end for operatively adjoining said second end to one of said main handle and said tool portion of said hand manipulatable implement, wherein said elongate and substantially rigid non-bending length portion and said lengthwise centerline extend toward said tool portion, thereby providing enhancements in work-quality and productivity and providing an economically advantageous combination of space savings, freedom of motion of said grip portion while balancing said hand manipulatable implement with minimum of effect on the orientation of said tool portion with respect to the ground, and an overall satisfying use experience.

144. The auxiliary handle assembly of claim 143, wherein said bendable portion has a cross sectional profile having a substantially rectangular shape.

145. The auxiliary handle assembly of claim 143, wherein said bendable portion has a rectangularly shaped sectional envelope for enabling flexure of said elongate member.

146. The auxiliary handle assembly of claim 145, wherein said bendable portion is comprised of a plurality of elongate wire-like elements.

147. The auxiliary handle assembly of claim 146, wherein said bendable portion is associated with said second end and forms arcuate shapes having widely varying values for bending radii whereby said widely varying values for bending radii substantially facilitate the motion of said first end relative to said second end.

148. The auxiliary handle assembly of claim 146, wherein said arcuate shapes having differing and varying bending radii relative to each other with the motion of said first end relative to said second end, substantially facilitate an ability of said first end to move relative to said second end in a direction transverse to a length of said bendable portion.

149. The auxiliary handle assembly of claim 145, wherein said bendable portion is comprised of a plurality of substantially thin elongate flat elements.

150. The auxiliary handle assembly of claim 143, including a restraining member configured as one of rigid or substantially rigid and having some flexure and overlaying an unsupported free-length portion of said bendable portion for modifying at least one of a character and a stress of said bending.

151. The auxiliary handle assembly of claim 143, wherein said rigid portion and said grip portion are integrally formed.

152. The auxiliary handle assembly of claim 143, wherein said attaching means includes a u-shaped fastener.

153. The auxiliary handle assembly of claim 143, wherein said attaching means includes a line contact means for clampingly engaging said hand manipulatable implement.

154. The auxiliary handle assembly of claim 143, including a pressure plate overlaying a cantilevered portion of said bendable portion for modifying bending curvature and manage loading of said bendable portion.

155. The auxiliary handle assembly of claim 143, wherein said elongate member at said second end forms an oblique angle with said attaching means for controlling bending radius.

156. An auxiliary handle for a hand held and hand manipulatable implement having a main handle and a working head, comprising:

(a) an elongate member having a first end and a second end, said elongate member including a substantially rigid non-bending length portion and a substantially flexible and bendable length portion for transmitting lifting and control forces from said first end towards said second end;

(b) a grip portion associated with said first end for grasping by a user and for imparting said user's wrist forces to said first end; and (c) an attaching means associated with said second end for operatively attaching said second end to one of said main handle and said working head of said hand held and hand manipulatable implement, wherein said elongate member is substantially comprised of a single contiguous material piece and includes a the substantially non-bending length portion associated with said first end and a the substantially flexible and bendable length portion associated with said second end for providing a cost effective, light-weight, reliable means for enhancing ergonomics and work productivity by providing a freedom of motion for said first end while effectively transmitting lifting and directional control forces from said first end towards said second end in an ergonomic and pleasing manner.

157. The auxiliary handle assembly of claim 156, wherein said elongate member is comprised of an inelastic material.

158. The auxiliary handle assembly of claim 156, wherein said elongate member is comprised of a thin flat material.

159. The auxiliary handle assembly of claim 156, wherein said elongate member is comprised of a resilient material.

160. The auxiliary handle assembly of claim 156, wherein said rigid non bending portion is comprised of substantially thin cross sectional profiles.

161. The auxiliary handle assembly of claim 160, wherein said bendable portion has a substantially rectangular cross sectional profile.

162. The auxiliary handle assembly of claim 161, wherein said grip portion is integrally formed with said elongate member.

163. The auxiliary handle assembly of claim 161, wherein said auxiliary handle assembly includes at least one of a unshaped fastener, top plate, retention clip, attaching means including line contact means, and fasteners having wings.

164. The auxiliary handle assembly of claim 163, wherein one of said retention clip and said line contact means is integrally formed with said auxiliary handle assembly portion.

165. The auxiliary handle assembly of claim 164, wherein both said retention clip and said line contact means are integrally formed with said auxiliary handle assembly portion.

166. The auxiliary handle assembly of claim 161, wherein said rigid non bending portion includes a cross sectional profile having at least one predominant channel like shape.

167. The auxiliary handle assembly of claim 161, wherein said elongate member includes at least one of: said grip portion integrally formed with said elongate member, said rigid non bending portion including a predominant channel like shape, said rigid non bending portion including a predominant channel like shape which faces said main handle, some or all of said attaching means integrally formed with said elongate member.

168. The auxiliary handle assembly of claim 161, wherein said rigid non bending portion includes a predominant channel like shape which faces said main handle.

169. The auxiliary handle assembly of claim 160, wherein said rigid non bending portion includes one of a predominant channel like shape and a predominant channel like shape which faces said main handle, whereby a useful combination of bending resistance, weight reduction, implement use in, a conventional manner, and storage space saving is accomplished.

170. The auxiliary handle assembly of claim 156, wherein said elongate member is comprised of a flexible metal.

171. The auxiliary handle assembly of claim 156, wherein said elongate member is integrally formed with said grip portion and with a portion of said attaching means.

172. The auxiliary handle assembly of claim 156, wherein said elongate member is comprised of thermoplastic.

173. The auxiliary handle assembly of claim 156, wherein said elongate member is comprised of a material composition including polyethylene.

174. The auxiliary handle assembly of claim 156, wherein said elongate member is comprised of a material selected from the polyethylene family of thermoplastics.

175. The auxiliary handle assembly of claim 156, wherein said elongate member is made by injection molding.

176. The auxiliary handle assembly of claim 156, wherein said bendable portion has a rectangular cross sectional profile.

177. The auxiliary handle assembly of claim 176, wherein said bendable portion varies in thickness to alter the character of bending.

178. The auxiliary handle assembly of claim 156, wherein said elongate member is made by at least one method selected from the group consisting of injection molding, thermoforming, blow-molding, metal sheet stamping, plastic sheet stamping, composite moldings, and wire assembly.

179. The auxiliary handle assembly of claim 156, wherein said rigid non-bending length portion includes a non-bending thin walled cross sectional profile for substantially facilitating torsion between said first end and said second end over the length of said non-bending length portion.

180. The auxiliary handle assembly of claim 179, wherein a cross section of said rigid non-bending length portion includes a predominant channel like shape for reducing handle weight while resisting bending and facilitating torsion.

181. The auxiliary handle assembly of claim 156 further comprising a retention clip extending from one of said grip portion or said elongate member and integrally formed therewith, wherein said retention clip is configured to releasably attach to said main handle.

182. The auxiliary handle assembly of claim 181, wherein said clip is formed in a first position and is foldable into a second position for use.

183. The auxiliary handle assembly of claim 181, wherein said clip is formed in a position proximate the interior opening of said grip portion.

184. The auxiliary handle assembly of claim 181, wherein said retaining clip as formed is in a position ready for use.

185. The auxiliary handle assembly of claim 156, wherein said attaching means includes a line contact means for aiding the prevention of yaw of said attaching means relative to said hand manipulatable implement.

186. The auxiliary handle assembly of claim 185, wherein said line contact means is integrally formed with said second end.

187. The auxiliary handle assembly of claim 186, wherein said attaching means includes a u-shaped fastener.

188. The auxiliary handle assembly of claim 185, wherein said attaching means includes a unshaped fastener.

189. The auxiliary handle assembly of claim 156, wherein said attaching means attaches to said working head.

190. The auxiliary handle assembly of claim 156, wherein said bendable length portion has a substantially rectangularly shaped cross section and said second end is pivotally attached to said hand manipulatable implement.

191. The auxiliary handle assembly of claim 156, wherein said auxiliary handle assembly is operatively attached to a backsaver shovel.

192. The auxiliary handle assembly of claim 156, wherein said auxiliary handle assembly is operatively attached to a vegetation trimmer.

193. The auxiliary handle assembly of claim 156, wherein said attaching means is by integral molding with one of said main handle and said working head.

194. The auxiliary handle assembly of claim 156, wherein said attaching means includes at least one attaching means selected from the group consisting of mechanical fasteners and adhesives and cooperating features.

195. The auxiliary handle assembly of claim 156, wherein said bendable length portion has a substantially rectangular cross sectional profile for facilitating the displacements and motions of said first end relative to said second end in at least one preferential direction of use of towards and away from said main handle and crosswise to said main handle.

196. The auxiliary handle assembly of claim 156, including one of a top plate, a top plate including an upward tip front edge portion, a top plate including an upward curve portion for overlaying a cantilevered portion of said bendable portion for modifying the bending curvature and loading of said bendable portion.

197. The auxiliary handle assembly of claim 196, wherein said top plate includes features which cooperate with said elongate member for retaining said elongate member to said hand manipulatable implement.

198. The auxiliary handle assembly of claim 156, wherein said elongate member is integrally formed with said grip portion.

199. The auxiliary handle assembly of claim 198, wherein said rigid non bending portion includes a cross sectional profile having at least one predominant channel like shape.

200. The auxiliary handle assembly of claim 198, wherein said rigid non bending portion includes a predominant channel like shape which faces said main handle.

201. The auxiliary handle assembly of claim 156, wherein said elongate member forms an A-shape.

202. The auxiliary handle assembly of claim 156, wherein said elongate member forms an A-shape and is operatively attached to said working head.

203. The auxiliary handle assembly of claim 156, wherein said bendable length portion has a substantially rectangularly shaped cross section and said second end is integrally molded with said working head.

204. The auxiliary handle assembly of claim 156, wherein said auxiliary handle assembly is integrally molded with said working head and includes means for attaching a main handle of said hand manipulatable implement.

205. The auxiliary handle assembly of claim 156, including a pivot yoke attaching means associated with said second end.

206. The auxiliary handle assembly of claim 205, wherein said pivot yoke attaching means is formed by integral molding with said second end.

207. The auxiliary handle assembly of claim 156, wherein said attaching means is comprised of a saddle for providing line contact mounting with said hand manipulatable implement.

208. The auxiliary handle assembly of claim 156, wherein said bendable length portion is configured for bending crosswise relative to said main handle.

209. The auxiliary handle assembly of claim 156, wherein said grip portion is fixedly repositionable along the length of said elongate member for adjusting the position of said grip portion relative to said second end.

210. The auxiliary handle assembly of claim 156, wherein said bendable length portion includes at least one of impinging ribs and apertures for advantageously controlling the bending radius of said bendable length portion.

211. The auxiliary handle assembly of claim 156, wherein said bendable portion includes a preformed twist.

212. The auxiliary handle assembly of claim 156, including a retaining clip having a substantially flat aspect and elongate flexible legs.

213. The auxiliary handle assembly of claim 156, further comprising a retaining clip deployed for use at an angle other than 90-degrees to said elongate member.

214. The auxiliary handle assembly of claim 156, including a retaining member having legs which form multiple retaining positions for temporarily retaining said first end and said grip portion onto said main handle of said hand manipulatable implement in any one of multiple retaining positions.

215. The auxiliary handle assembly of claim 156, wherein said attaching means enables said auxiliary handle assembly to be transferred from one hand manipulatable implement to another hand manipulatable implement.

216. The auxiliary handle assembly of claim 156, wherein said elongate member at said second end forms an oblique angle with said attaching means for controlling bending radius.

217. The auxiliary handle assembly of claim 156, wherein said rigid non bending portion includes a cross section having at least one predominant channel like shape for resisting bending.

218. The auxiliary handle assembly of claim 156, wherein said substantially rigid non-bending length portion associated with said first end is adjacent to said first end and said substantially flexible and bendable length portion associated with said second end is adjacent to said second end.

219. The auxiliary handle assembly of claim 156, wherein said substantially rigid non-bending length portion associated with said first end is adjacent to said first end.

220. The auxiliary handle assembly of claim 156, wherein said substantially flexible and bendable length portion associated with said second end is adjacent to said second end.

221. The auxiliary handle assembly of claim 156, wherein said elongate member is including another said substantially flexible and bendable length portion adjacent to said first end.

222. The auxiliary handle assembly of claim 156, wherein said elongate member is including another said substantially rigid non-bending length portion adjacent to said second end.

223. A movable auxiliary handle for use with a hand held and hand manipulatable implement having a main handle and a tool portion comprising:

(a) an elongate body member of length having a first end and a second end wherein said body member is movable relative to said hand manipulatable implement;

(b) a grip portion associated with said first end for imparting lifting forces to said first end for conveyance through said body member to said hand manipulatable implement;

(c) an attaching means associated with said second end for operatively adjoining said second end to said hand manipulatable implement, (d) a retention clip including at least one elongate leg portion wherein said at least one elongate leg portion as positioned for use is positioned on or on at least one side of a central axis of said auxiliary handle and projects substantially away from said central axis and wherein said central axis extends therealong from said grip portion to said attaching means and wherein said retention clip is integrally manufactured with one of said elongate body member or said grip portion wherein said retention clip is integral as one of:

(i) pre-positioned for use wherein the portions of said at least one elongate leg portion which lay proximate to said hand manipulatable implement during retaining use are substantially visually unimpeded by the constituent material of said one of said elongate body member or said grip portion when the position of viewing is orthogonal to a plane simultaneously substantially parallel to said grip portion and tangent to said first end and is vertically above said retention clip on the opposite side of the projection of said at least one leg portion relative to said plane;

(ii) redeployable from a first position as manufactured into a second position for use wherein as configured for manufacture the portions of said at least one elongate leg portion which lay proximate to said hand manipulatable implement during retaining use are substantially visually unimpeded by the constituent material of said one of said elongate body member or said grip portion when the position of viewing is orthogonal to a plane simultaneously substantially parallel to said grip portion and tangent to said first end and is vertically above said retention clip on the opposite side of the projection of said at least one leg portion relative to said plane;

whereby said clip described by item (i) and (ii) provides a substantial convenience and economy for manufacturing and use and a reduction of assembly parts count and inventory of said retention clip.

224. The movable auxiliary handle of claim 223 wherein said grip defines an orifice and said retention clip extends from the perimeter of said orifice.

225. The auxiliary handle assembly of claim 223, wherein said retention clip is having a substantially flat aspect and elongate flexible legs.

226. The auxiliary handle assembly of claim 223, wherein said retention clip is deployed for use at an angle other than 90-degrees to said elongate body member.

227. The auxiliary handle assembly of claim 223, wherein said retention clip includes retention legs forming multiple retaining positions for temporarily retaining said first end and said grip portion onto said main handle of said hand manipulatable implement in any one of multiple retaining positions.

228. An auxiliary handle assembly for a hand held and hand manipulatable implement having a main handle and a working head, comprising:

(a) an elongate member having a first end and a second end for effectively transmitting lifting force from the user's wrist from said first end to said second end;

(b) a grip portion associated with said first end for grasping by a user and for imparting a user's wrist forces to said first end; and (c) an attaching means associated with said second end for operatively attaching said second end to one of said main handle and said working head of said hand held and hand manipulatable implement;

wherein said elongate member includes a substantially non-bending linear length portion having a thin walled cross sectional profile forming at least one predominant channel like shape in said substantially non-bending linear length portion for resisting bending in said linear length portion, and wherein said auxiliary handle assembly is configured as at least one of the following:

(i) wherein said substantially non-bending linear length portion is substantially torsionable over its length and is comprised of at least one material selected from the group of metals and thermoplastics, (ii) wherein said channel like shape faces said main handle and wherein said main handle is able to lay within the profile envelope of said channel like shape, (ii) wherein said channel like shape faces said main handle and wherein said main handle is able to lay within the profile envelope of said channel like shape and wherein said substantially non-bending linear length portion comprises a substantial length of said elongate member, (iv) wherein said cross sectional profile is formed by a shape characterized as a polygon having at least one side missing and wherein said channel like shape faces said main handle and wherein said main handle is able to lay within the profile envelope of said channel like shape, (v) wherein said cross sectional profile is substantially comprised of an arcuate profile shape, (vi) wherein said cross sectional profile is substantially comprised of an arcuate profile shape, and wherein said channel like shape faces said main handle and wherein said main handle is able to lay within the profile envelope of said channel like shape, whereby an advantageous combination of the following is accomplished: a substantially non-bending length portion which is light in weight, aids torsion between said ends of said auxiliary handle assembly without need for springs or additional features, facilitates grasping of the implement in the usual manner, provides an economy of storage space, enables transfer of directional and pushing control forces across said non-bending linear length portion, is economical to manufacture, and contributes to a pleasing and modern auxiliary handle appearance.

229. The auxiliary handle assembly of claim 228, wherein said substantially non-bending linear length portion comprises a substantial length of said elongate member.

230. The auxiliary handle assembly of claim 228, wherein said attaching means includes a pivot means.

231. The auxiliary handle assembly of claim 230, wherein a portion of said pivot means is formed integrally with said second end.

232. The auxiliary handle assembly of claim 230, wherein said attaching means includes a tang.

233. An auxiliary handle assembly for a hand held and hand manipulatable implement having a main handle and a working head, comprising:

(a) an elongate body member having a first end and a second end for effectively transmitting lifting force from a user's wrist from said first end to said second end;

(b) a grip portion associated with said first end for grasping by said user and for imparting said user's wrist forces to said first end; and (c) an attaching means associated with said second end for operatively attaching said second end to one of said main handle and said working head of said hand held and hand manipulatable implement;

wherein said auxiliary handle assembly includes a retention clip having at least one elongate flexible leg having a predominantly flat aspect emanating outwardly and away from said auxiliary handle assembly and wherein a portion of said hand manipulatable implement passes adjacent to said flat aspect of said retention clip such that the operating forces of retention act in a manner that is substantially parallel to said flat aspect whereby a substantially strong retaining action and light weight and function-reliable and dynamically pleasing retaining clip member is accomplished.

234. The auxiliary handle assembly of claim 233, wherein said retention clip leg twists about its length to engage said hand manipulatable implement.

235. The auxiliary handle assembly of claim 233, wherein said clip is integrally formed with one of said grip portion and said elongate body member.

236. The auxiliary handle assembly of claim 235, wherein said clip is integrally formed in a position ready for use.

237. The auxiliary handle assembly of claim 233, wherein said retention clip is integrally molded with said elongate body member.

238. The auxiliary handle assembly of claim 233, wherein said retention clip is integrally formed with said grip portion.

239. The auxiliary handle assembly of claim 233, wherein said clip is comprised of thermoplastic.

240. The auxiliary handle assembly of claim 233, wherein said clip is comprised of sheet metal.

241. The auxiliary handle assembly of claim 233, wherein said clip is integrally adjoined with one of said grip portion and said elongate body member and folds from a first position into a second position for use.

242. The auxiliary handle assembly of claim 233, wherein said clip is integrally formed with one of said grip portion and said elongate body member and is movable from a first position into a second position for use.

243. The auxiliary handle assembly of claim 233, wherein said retention clip in a position for use forms a non-orthogonal angle at its connection with said auxiliary handle assembly.

244. The auxiliary handle assembly of claim 233, wherein the legs of said retention clip become narrower in profile so to manage the mechanics of impingement to and release from said hand manipulatable implement.

245. The auxiliary handle assembly of claim 233, wherein the legs of said retention clip become thinner in thickness toward the end of said legs so to manage the mechanics of impingement to and release from said hand manipulatable implement.

246. The auxiliary handle assembly of claim 233, wherein the legs of said retention clip become narrower in profile and thinner in thickness toward the end of said legs so to manage the mechanics of impingement to and release from said hand manipulatable implement.

247. The auxiliary handle assembly of claim 233, wherein said retention clip is formed with and is adjoining an interior perimeter profile of said grip portion.

248. The auxiliary handle assembly of claim 233, wherein a profile shape of said retention clip is formed in substantially the same plane as a perimeter profile shape of said grip portion.

249. The auxiliary handle assembly of claim 233, wherein said retention clip includes retention legs forming multiple positions for temporarily retaining said first end and said grip portion onto said main handle of said hand manipulatable implement in any one of multiple retaining positions.

250. An auxiliary handle assembly for a hand held and hand manipulatable implement having a main handle and a working head, comprising:

(a) an elongate member having a first end and a second end and having a flexible and bendable portion proximate said second end for effectively transmitting lifting force from the user's wrist from said first end to said second end;

(b) a grip portion associated with said first end for grasping by a user and for imparting a user's wrist forces to said first end;

(c) an attaching means associated with said second end for operatively attaching said second end to one of said main handle and said working head of said hand held and hand manipulatable implement; and wherein said auxiliary handle assembly is operatively attached in cantilevered fashion to said hand manipulatable implement, and wherein said auxiliary handle assembly includes a substantially rigid member extending toward said first end and overlaying said elongate member at a point distal from said attachment of said second end and restraining a cantilevered portion of said flexible and bendable portion so as to manage the bending and the loading stresses of said flexible and bendable portion with the motion of said first end relative to said second end.

251. The auxiliary handle assembly of claim 250, wherein said substantially rigid member includes a curved portion for managing bending loads.

252. The auxiliary handle assembly of claim 250, wherein said substantially rigid member is comprised of material including at least one of a metal and a thermoplastic.

253. The auxiliary handle assembly of claim 250, wherein said substantially rigid member facilitates the attachment of said auxiliary handle assembly to said hand manipulatable implement.

254. The auxiliary handle assembly of claim 253, wherein said substantially rigid member includes interlocking features which cooperate with interlocking features in at least one of said attaching means and said elongate member to operatively attach said auxiliary handle assembly to said hand manipulatable implement.

255. An auxiliary handle assembly for a hand held and hand manipulatable implement having a main handle and a working head, comprising:

(a) an elongate member having a first end and a second end for effectively transmitting lifting force from the user's wrist from said first end to said second end;

(b) a grip portion associated with said first end for grasping by a user and for imparting a user's wrist forces to said first end; and (c) an attaching means associated with said second end for operatively attaching said second end to one of said main handle and said working head of said hand held and hand manipulatable implement;

wherein said grip portion is movable relative to said attaching means and wherein said attaching means is comprised of a mounting having features providing a plurality of discrete longitudinal line contacts with said hand manipulatable implement along each of two longitudinal axes located on opposite sides of a lengthwise centerline of said hand manipulatable implement and wherein the total length of said line contact on each side of said lengthwise centerline is equal to or greater than the distance between said longitudinal axes, and includes at least one u-shaped fastener cooperating therewith, and wherein said line contacts and said at least one u-shaped fastener provides the sole means of support for said attaching means for operatively attaching said auxiliary handle assembly to a wide variety of said hand manipulatable implements in a cost effective, expedient, secure, and attachment-space-minimizing manner.

256. The auxiliary handle assembly of claim 255, wherein at least one of said plurality of discrete lines of contact is located on each side of the center axis of said main handle.

257. The auxiliary handle assembly of claim 255, wherein said discrete lines of contact lie substantially on only two longitudinal axes which are located on each side of the center axis of said main handle.

258. The auxiliary handle assembly of claim 257, wherein said u-shaped fastener is a u-bolt.

259. The auxiliary handle assembly of claim 257, wherein the total length of said discrete lines of contact on each side of said center axis is greater than or equal to the distance between said two longitudinal axes.

260. The auxiliary handle assembly of claim 259, wherein said u-shaped fastener is a u-bolt.

261. The auxiliary handle assembly of claim 255, wherein said attaching means has a single line of contact located on each side of the center axis of said main handle.

262. The auxiliary handle assembly of claim 255, wherein said auxiliary handle assembly includes a flexible and bendable portion enabling said first end to move relative to said attaching means.

263. The auxiliary handle assembly of claim 255, wherein said attaching means has a single U-shaped fastener.

264. The auxiliary handle assembly of claim 255, wherein said u-shaped fastener is a u-bolt.

265. The auxiliary handle assembly of claim 255, wherein said attaching means includes fasteners having wings for attaching onto said u-shaped fastener for facilitating at least one of attachment and adjustment of said auxiliary handle assembly without the need for tools.

266. The auxiliary handle assembly of claim 255, wherein said features providing discrete longitudinal line contact are integrally formed with said second end.

267. The auxiliary handle assembly of claim 266, wherein said u-shaped fastener is a u-bolt.

268. The auxiliary handle assembly of claim 267, including fasteners having wings for attaching onto said u-shaped fastener for facilitating at least one of attachment and adjustment of said auxiliary handle assembly without the need for tools.

269. The auxiliary handle assembly of claim 255, including a substantially non-bending member overlaying and restraining a cantilevered flexible and bendable portion of said elongate member for modifying the character of bending and stresses of said flexible portion.

270. The auxiliary handle assembly of claim 255, wherein said attaching means includes a pivot mount for operatively attaching said second end to said attaching means.

271. The auxiliary handle assembly of claim 270, wherein said u-shaped fastener is a u-bolt.

272. The auxiliary handle assembly of claim 255, wherein said mounting further comprises first interlocking features and said elongate member further comprises second interlocking features wherein said first and second interlocking features cooperate to prevent relative motion therebetween for facilitating the attaching of said auxiliary handle assembly second end to said hand manipulatable implement.

273. The auxiliary handle assembly of claim 255, wherein said mounting forms a saddle and said discrete longitudinal line contact is formed by a surface of said saddle.

274. The auxiliary handle assembly of claim 255, wherein said discrete longitudinal line contact is formed by rib features.

275. An auxiliary handle for a hand held and hand manipulatable implement having a main handle and a working head, comprising:

(a) an elongate member having a first end and a second end, said elongate member including at least one substantially rigid non-bending length portion and at least one substantially flexible and bendable length portion for transmitting lifting and control forces from said first end towards said second end;

(b) a grip portion associated with said first end for grasping by a user and for imparting said user's wrist forces to said first end; and (c) an attaching means associated with said second end for operatively attaching said second end to one of said main handle and said working head of said hand held and hand manipulatable implement, wherein said elongate member is substantially comprised of a single contiguous material piece wherein said elongate member is contiguous as one of:

(i) an arrangement wherein at least one of said at least one substantially flexible and bendable length portions is positioned as one of proximate to or adjacent to said first end, and wherein at least one of said at least, one substantially rigid non-bending length portions is proximate to said second end relative to said at least one substantially flexible and bendable length portion which is positioned as one of proximate to or adjacent to said first end, (ii) an arrangement wherein a first said at least one substantially flexible and bendable length portion is positioned as one of proximate to or adjacent to said first end, and wherein a second said at least one substantially flexible and bendable length portion is positioned as one of proximate to or adjacent to said second end, and wherein at least one of said at least one substantially rigid non-bending length portions is positioned between said first at least one substantially flexible and bendable length portion and said second at least one substantially flexible and bendable length portion, (iii) an arrangement wherein at least one of said at least one substantially flexible and bendable length portions is located within the length of said elongate member and is located between at least two of said at least one substantially rigid non-bending length portions, (iv) an arrangement wherein at least one of said at least one substantially flexible and bendable length portions is positioned as one of proximate to or adjacent to said second end, and wherein at least one of said at least one substantially rigid non-bending length portions is proximate to said first end relative to said at least one substantially flexible and bendable length portion which is positioned as one of proximate to or adjacent to said second end, whereby said auxiliary handle assembly provides a cost effective, light-weight, reliable means for enhancing ergonomics and work productivity by providing a freedom of motion for said first end while effectively transmitting lifting and directional control forces from said first end towards said second end in an ergonomic and pleasing manner.

276. The auxiliary handle assembly of claim 275, wherein said elongate member is comprised of material including at least one of a metal and a thermoplastic.

277. The auxiliary handle assembly of claim 275, wherein said at least one substantially rigid non-bending length portion includes one of a predominant channel like shape and a predominant channel like shape which faces said main handle, whereby a useful combination of bending resistance, weight reduction, implement use in a conventional manner, and storage space saving is accomplished.

* * * * *